US009387498B2

(12) United States Patent
Hagata et al.

(10) Patent No.: US 9,387,498 B2
(45) Date of Patent: Jul. 12, 2016

(54) SHEARING DISPERSER, CIRCULATION-TYPE DISPERSING SYSTEM, AND CIRCULATION-TYPE DISPERSING METHOD

(75) Inventors: Yutaka Hagata, Toyokawa (JP); Masaya Hotta, Toyokawa (JP); Yuu Ishida, Toyokawa (JP); Katsuaki Odagi, Toyokawa (JP)

(73) Assignee: SINTOKOGIO LTD., Nogoya-Shi, Aichi (JP)

( * ) Notice: Subject to any disclaimer, the term of this patent is extended or adjusted under 35 U.S.C. 154(b) by 487 days.

(21) Appl. No.: 13/807,353

(22) PCT Filed: Jun. 24, 2011

(86) PCT No.: PCT/JP2011/064500

§ 371 (c)(1),
(2), (4) Date: Mar. 8, 2013

(87) PCT Pub. No.: WO2012/042990

PCT Pub. Date: Apr. 5, 2012

(65) Prior Publication Data

US 2013/0186970 A1 Jul. 25, 2013

(30) Foreign Application Priority Data

Sep. 29, 2010 (JP) ..... 2010-218788
Feb. 17, 2011 (JP) ..... 2011-032376

(51) Int. Cl.
*B01F 7/06* (2006.01)
*B01F 5/06* (2006.01)
(Continued)

(52) U.S. Cl.
CPC . *B05B 7/04* (2013.01); *B01F 5/104* (2013.01); *B01F 5/106* (2013.01);
(Continued)

(58) Field of Classification Search
CPC .... B01F 7/00766; B01F 7/18; B01F 7/00266; B01F 7/00708
See application file for complete search history.

(56) References Cited

U.S. PATENT DOCUMENTS 2,009,957 A * 7/1935 Esch ..... B01F 7/00758 241/188.2
2,478,893 A * 8/1949 Brant ..... A01J 11/16 219/421
(Continued)

FOREIGN PATENT DOCUMENTS

JP 08-089775 A 4/1996
JP 2000-153167 6/2000
(Continued)

OTHER PUBLICATIONS

International Search Report dated Sep. 27, 2011 issued in International Application No. PCT/JP2011/064500, 2 pages.

*Primary Examiner* — Tony G Soohoo
(74) *Attorney, Agent, or Firm* — Finnegan, Henderson, Farabow, Garrett & Dunner, L.L.P.

(57) ABSTRACT

The present invention provides a disperser that gives a local dispersing effect and a homogenous dispersing effect and that achieves a more efficient dispersion. The shearing disperser comprising a rotor and an opposing member that is opposite the rotor, wherein the disperser disperses a slurry or liquid mixture by allowing the mixture to pass through the disperser and outwardly between the rotor and the opposing member by centrifugal force, and wherein the disperser further comprises a plurality of gaps that are provided between the rotor and the opposing member and lead the mixture outwardly; and a buffering space that is provided to connect an outermost gap to a gap located in a position inward from the outermost gap and that retains the mixture.

26 Claims, 21 Drawing Sheets

(51) Int. Cl.

| | |
|---|---|
| ***B05B 7/04*** | (2006.01) |
| ***B01F 5/10*** | (2006.01) |
| ***B01F 7/00*** | (2006.01) |
| ***B01F 7/18*** | (2006.01) |
| ***B01F 15/02*** | (2006.01) |
| ***B01F 15/06*** | (2006.01) |

(52) U.S. Cl.

CPC ..... *B01F 7/00225* (2013.01); *B01F 7/00266* (2013.01); *B01F 7/00708* (2013.01); *B01F 7/00766* (2013.01); *B01F 7/18* (2013.01); *B01F 15/0251* (2013.01); *B01F 15/065* (2013.01); *B01F 15/068* (2013.01); *B01F 2015/061* (2013.01)

(56) References Cited

U.S. PATENT DOCUMENTS

| | | | | | |
|---|---|---|---|---|---|
| 2,645,464 | A | * | 7/1953 | Davidson | B01F 7/00766 106/277 |
| 3,672,161 | A | * | 6/1972 | Krusche | F16H 61/465 180/6.48 |
| 4,011,027 | A | * | 3/1977 | Selder | B01F 7/00758 241/188.2 |
| 4,061,275 | A | * | 12/1977 | Herfeld | 241/46.04 |
| 4,194,843 | A | * | 3/1980 | Martin | A47J 31/401 366/138 |
| 4,201,487 | A | * | 5/1980 | Backhaus | A47J 43/04 366/159.1 |
| 4,687,339 | A | * | 8/1987 | Seeger | B01F 7/00766 366/303 |
| 5,042,726 | A | * | 8/1991 | Reinhall | B01F 7/00758 241/259.1 |
| 5,597,127 | A | * | 1/1997 | Brown | B02C 13/205 241/188.2 |
| 5,727,743 | A | * | 3/1998 | Schneid | B01F 7/00758 241/261.3 |
| 5,730,376 | A | * | 3/1998 | Schneid | B01F 15/0293 241/245 |
| 5,759,604 | A | * | 6/1998 | Bottlinger | B01F 7/00758 366/138 |
| 6,238,082 | B1 | * | 5/2001 | Takemura | B01F 7/00758 366/304 |
| 6,286,771 | B1 | * | 9/2001 | Brown, Jr. | B02C 19/0037 241/162 |
| 6,866,412 | B2 | * | 3/2005 | Bachelier | B01F 7/00866 366/294 |
| 2004/0032792 | A1 | | 2/2004 | Enomura | |
| 2006/0266847 | A1 | | 11/2006 | Enomura | |
| 2010/0273898 | A1 | | 10/2010 | Enomura | |
| 2010/0307601 | A1 | | 12/2010 | Gabriel et al. | |

FOREIGN PATENT DOCUMENTS

| | | | |
|---|---|---|---|
| JP | 2002-519199 | A | 7/2002 |
| JP | 2004-049957 | A | 2/2004 |
| JP | 2006/071697 | A | 3/2006 |
| WO | WO 00/01792 | | 1/2000 |
| WO | WO 2009/060661 | A1 | 5/2009 |
| WO | WO 2009/068535 | A1 | 6/2009 |

* cited by examiner

SHEARING DISPERSER, CIRCULATION-TYPE DISPERSING SYSTEM, AND CIRCULATION-TYPE DISPERSING METHOD

TECHNICAL FIELD

The present invention relates to a shearing disperser, a circulation-type dispersing system, and a circulation-type dispersing method, for dispersing a material in a slurry or liquid form.

BACKGROUND OF THE INVENTION

Conventionally, an apparatus that causes a plurality of liquid materials or a powder material in a slurry to pass through a narrow gap between a rapidly rotating rotor and a stator that does not rotate such that those materials are continuously dispersed by a strong shearing force caused by the rapid rotation has been known (for example, Patent document 1). Incidentally, the term "dispersing" shall mean uniformly dispersing a powder material in a slurry, or uniformly mixing a plurality of liquids. The disperser disclosed in Patent document 1, etc., has flat opposing surfaces where the rotor and the stator face each other such that dispersing is carried out by a shearing force generated between the surfaces.

However, the disperser has a problem in that a raw material discharged from the disperser must be reapplied to the disperser by means of a pump, etc., to circularly disperse it, or two or more of the dispersers must be connected in series to carry out two or more dispersing steps, if a desired dispersive state cannot be achieved in one pass, because the raw material quickly passes through the gap between the rotor and the stator.

Also, the disperser has a problem in that dispersing cannot be carried out efficiently and appropriately, because small grains that do not need to be dispersed receive excessive shearing energy, if the time for dispersion is set at a time sufficient to cause the coarse grains (aggregated bodies) that need to be dispersed to disappear. Incidentally, herein a small grainy material formed by solid particles (powder materials) and an aggregate consisting of an aggregated body of them shall both be referred to as "the grains."

Patent document 1: JP2000-153167

DISCLOSURE OF INVENTION

The purpose of the present invention is to provide a shearing disperser and a circulation-type dispersing system that enable a more efficient and appropriate dispersion.

The shearing disperser of the present invention comprises a rotor and an opposing member that is opposite the rotor. The disperser disperses a slurry or liquid mixture by allowing the mixture to pass through the disperser and outwardly between the rotor and the opposing member by centrifugal force. The disperser further comprises a plurality of gaps that are provided between the rotor and the opposing member and that lead the mixture outward; and a buffering space that is provided to connect an outermost gap and a gap located in a position inward from the outermost gap and that retains the mixture. The buffering space is configured such that an outer circumferential wall that defines the buffering space is provided on the rotor.

Also, the circulation-type dispersing system of the present invention comprises the above shearing disperser; a tank that is connected to an outlet side of the shearing disperser; a circulating pump for circulating the mixture; and a pipe for serially connecting the shearing disperser, the tank, and the circulating pump. The system disperses the mixture while circulating it.

Also, the circulation-type dispersing method of the present invention is one for dispersing a mixture while circulating it by means of a circulation-type dispersing system, wherein the system comprises: a shearing disperser; a tank connected to the outlet side of the shearing disperser; a circulating pump for circulating the mixture; and a pipe for serially connecting the shearing disperser, the tank, and the circulating pump. The shearing disperser is provided with a rotor and an opposing member that is opposite the rotor. The disperser disperses the mixture in a slurry or liquid form by allowing the mixture to pass through the disperser and outwardly between the rotor and the opposing member by centrifugal force. The shearing disperser further comprises the following: a plurality of gaps located between the rotor and the opposing member and that lead the mixture outwardly; and a buffering space that connects an outermost gap and a gap located in a position inward from the outermost gap and that retains the mixture. The buffering space is configured such that an outer circumferential wall that defines the buffering space is provided on the rotor.

EFFECT OF THE INVENTION

The present invention gives a local dispersing effect caused by the shearing force that is generated while a mixture passes through a plurality of gaps. Also, the present invention gives a dispersing effect by retaining the mixture to make it homogenized. Further, the present invention gives a dispersing effect by rubbing the mixture against the outer circumferential wall of the rotor in the buffering space by means of the centrifugal force generated against the mixture retained in the buffering space that is connected to the outermost gap. Accordingly, a more efficient and appropriate dispersion is achieved.

BRIEF DESCRIPTION OF THE DRAWINGS

FIG. 13 illustrates the viscosity and the concentration in relation to the processing time in the method of gradually diluting.

FIG. 19 is a schematic sectional view of an example where the system has a decompressing mechanism.

FIG. 20 shows a schematic sectional view of the example where the positions of the screw-type powder feeder and the agitator are changed.

FIG. 22 shows a schematic sectional view of an example where the tank alone is used.

DETAILED DESCRIPTION OF THE INVENTION

Figure 1:
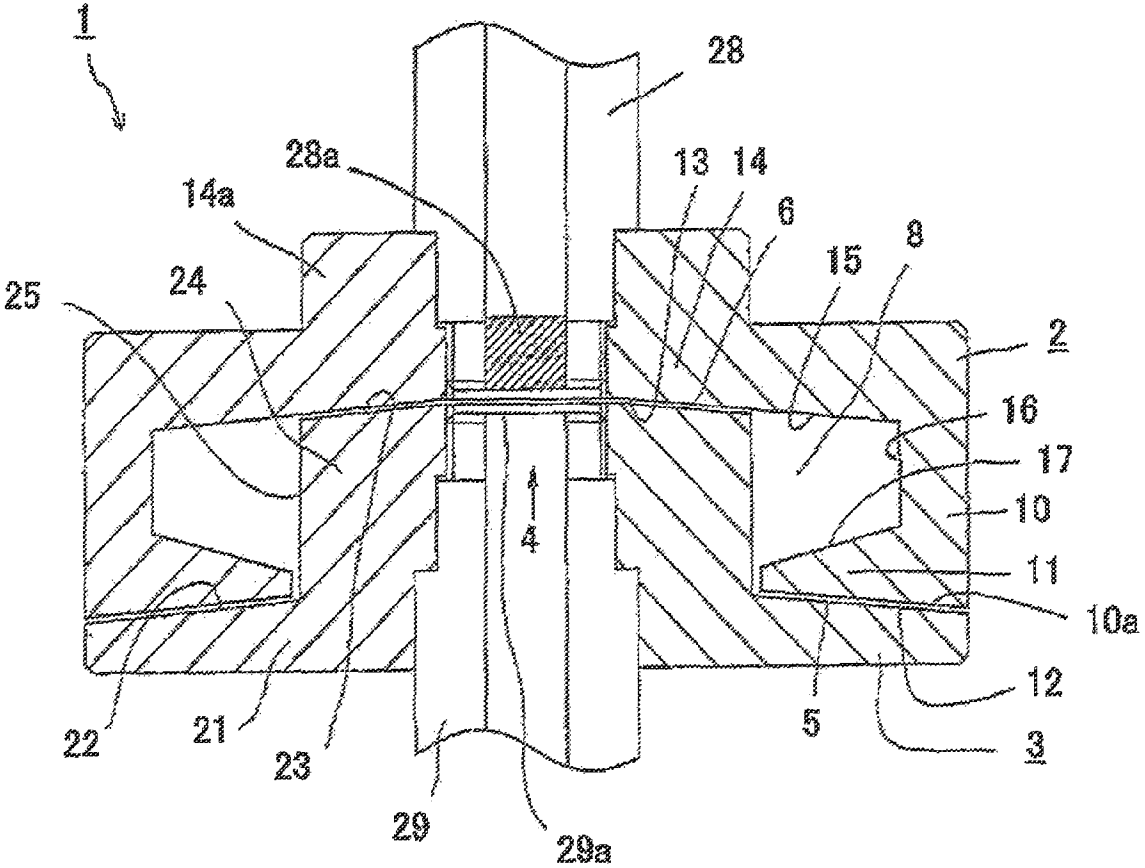
FIG. 1 is a schematic sectional view of the shearing disperser of the present invention.

Hereafter, the shearing disperser of the present invention will be explained with reference to the drawings. The shearing disperser shown below disperses a mixture in a slurry form while circulating it (this is also referred to as "solid-liquid" dispersing or "slurrying"). Or, the disperser disperses a liquid mixture while circulating it (this is also referred to as "liquid-liquid" dispersing, or "emulsifying"). The term "dispersing" means dispersing materials in the mixture. Namely, the term means uniformly dispersing each material in the mixture. In the following description, the term "outer circumferential" and the term "outer" mean the direction wherein the radius of the rotation of the rotor becomes greater toward the outer circumference. Also, the term "inner circumferential" and the term "inner" mean the direction wherein the radius of the rotation of the rotor becomes smaller toward the inner circumference. In the following description, the term "upper side" and the term "upper" mean a direction running from an opposing member to a rotor, when the rotor and the stator are disposed to face each other in a vertical direction. Also, the term "lower side" and the term "lower" mean a direction running from a rotor to an opposing member when the rotor and the stator are disposed to face each other in a vertical direction. (For example, in FIG. 1, the left side in the figure is the "upper side" or "upper," and the right side in the figure is the "lower side" or "lower.")

First, the shearing disperser 1 of the present invention in FIG. 1 (hereafter, the shearing disperser is referred to just as a "disperser") will be explained. The disperser 1 comprises a rotor 2, and a stator 3 that is a member disposed to oppose the rotor 2. The disperser 1 disperses a slurry or liquid mixture 4 by allowing the mixture to pass through the disperser 1 and pass outwardly between the rotor 2 and the opposing member (the stator 3) by centrifugal force.

Also, the disperser 1 comprises a first gap 5 and a second gap 6, as the plurality of gaps, and a buffering space 8. The plurality of gaps (the first and the second gaps 5, 6) are located between the rotor 2 and the stator 3. The gaps outwardly lead the mixture 4 that is supplied to the central position of the axis. Namely, the plurality of gaps are provided between respective opposing surfaces of the rotor and opposing member that are disposed to face each other such that the plurality of gaps radially lead the mixture from the center to the outer circumference. The first gap 5 is provided at an outer circumferential position. The second gap 6 is provided at the side of the center of the rotation. The plurality of gaps are provided at different positions along the central axis such that they define the buffering space 8, etc. The buffering space 8, which is provided between the respective opposing surfaces that are provided on the rotor 2 and the stator 3, is provided to connect the outermost gap (the first gap 5) and the gap located in a position inward from the outermost gap (the second gap 6). The space retains the mixture 4. An outer circumferential wall 10 that defines the buffering space 8 is provided on the rotor 2.

The outer circumferential wall 10, which is provided on the rotor 2 to define the buffering space 8, has a projecting member 11 that extends toward the center of the rotation along an end 10*a* that opposes the opposing member (stator 3). The rotor 2 has flat gap-defining surfaces 12, 13 for defining the first and the second gaps 5, 6. Particularly, the rotor 2 has a rotor body 14 that is attached to a rotating shaft 28. Also, the rotor 2 has the wall 10, which extends from an outer circumferential position of the rotor body 14 to the stator 3. The rotor body 14 is formed like a disc. The rotor body 14 has a fixing member 14*a* for fixing the rotor body to the rotating shaft 28. For example, a fixing screw is provided at an inner circumferential position of the rotor body 14 and at an outer circumferential position of the rotating shaft 28. The gap-defining surface 13, which defines the second gap 6, is provided at an inner circumferential position of the inner surface on the stator 3 of the rotor body 14. The outer circumferential part of the gap-defining surface 13 serves as a buffering-space-defining surface 15 for defining the upper side of the buffering space 8. In this example, the buffering-space-defining surface 15 is provided on the same plane where the gap-defining surface 13 is provided. The inner side of the wall 10 serves as a buffering-space-defining surface 16 for defining the outer circumferential side of the buffering space 8. The gap-defining surface 12, which defines the first gap 5, is provided at the side toward the stator 3 on the projecting member 11 that is formed to continue to the wall 10. The buffering-space-defining surface 17, which defines the lower side of the buffering space 8, is provided on the opposite side (upper side) of the projecting member 11.

The stator 3 has flat surfaces 22, 23 for defining the first and the second gaps 5, 6. Specifically, the stator 3 is integrally attached to an axial member 29. The stator 3 comprises a disc-like stator body 21 and an extending wall 24 on an inner circumferential part of the stator body 21. The extending wall 24 extends toward the rotor 2. For example, a fixing screw is provided on the inner circumferential side of the extending wall 24 and on the outer circumferential side of the axial member 29. The gap-defining surface 23, which defines the second gap 6, is provided on the rotor 2 toward the extending wall 24. The outer side of the extending wall 24 serves as a gap-defining surface 25 for defining the inner side of the buffering space 8. The gap-defining surface 22, which defines the first gap 5, faces the rotor 2 and is disposed on an outer circumferential part of the stator body 21.

The plurality of gaps have a relationship in which a gap located in an outer circumferential position is narrower than a gap located in an inner circumferential position. Namely, the gap-defining surfaces 12, 13, 22, 23 are each provided such that the first gap 5 is narrower than the second gap 6. The first gap 5 and the second gap 6 are each provided to have a width of 2 mm or less (from 0.01 mm to 2.00 mm) between the rotor 2 and the stator 3.

The rotor 2 and the opposing member (stator 3) are disposed such that the rotating shaft of the rotor 2 is parallel to the vertical direction. The opposing member (stator 3) is located at a lower position. In this way, the disperser can discharge the mixture remaining in the disperser (particularly in the buffering space 8) after the dispersion is completed, without disassembling the disperser. Accordingly, the yield of the dispersion can be improved.

The opposing member (stator 3) is formed such that a part of the opposing member, which part defines the first and the second gaps 5, 6, slopes downward from its inner circumference to its outer circumference. Similarly, the rotor 3 is also formed such that a part of the rotor, which part defines the first and the second gaps 5, 6, slopes downward from its inner circumference to its outer circumference. Namely, the gap-defining surfaces 12, 13, 22, 23 and the first and the second gaps 5, 6 are each formed to slope downward from their inner circumferences to their outer circumferences. Also, the upper surface of the projecting member 11 is formed such that it slopes downward from its inner circumference to its outer circumference. The disperser 1, which is configured like this, can discharge the mixture remaining in it after the dispersion is completed, without disassembling the disperser. Accordingly, the yield of the dispersion may be improved. This is effective especially when a slurry mixture having a high viscosity is processed.

A supplying opening 29*a* for supplying the mixture 4 is provided on the axial member 29 in the stator 3. Specifically, the axial member 29 is formed in a cylindrical (pipe-like) shape. The mixture 4 is supplied through the inside of the axial member. The rotating shaft 28 of the rotor 2 is formed in a cylindrical (pipe-like) shape. The occluding member 28*a* is provided at the tip of the rotating shaft. Incidentally, the present invention is not limited to this. The rotor 2 or the opposing member (stator 3) or both of them may have a supplying opening for supplying the mixture 4 from the center of the rotation (of the rotor 2). Both of them may have a supplying opening such that different kinds of materials can be supplied through the supplying openings to have them mixed and dispersed in the disperser. However, if a slurry mixture having a high solid content concentration (hereafter "high solid content concentration" is also referred to as a "high concentration") is processed and a sealing member has low durability, the configuration where a mixture is supplied from the supplying opening 29*a* that is formed at the center of the stator 3 is advantageous, as explained above with reference to FIG. 1. Namely, to supply the mixture 4 from the supplying opening 29*a*, a mixture-supplying pipe, such as a hose, is connected to the axial member 29. For example, if a supplying opening is formed on the rotor, a joint (a rotary joint) for connecting the mixture-supplying pipe to the supplying opening is required. Occasionally the sealing member to connect the rotary joint may be easily impaired if a highly concentrated slurry mixture is dispersed. The mixture may leak due to the impaired sealing mechanism. In this way, the supplying opening 29*a* formed on the stator 3 may eliminate the need for using a rotary joint and may prevent problems such as a leakage from occurring.

The dispersion by means of the above dispersers 1 will now be explained. First, aggregates of large grains in the mixture supplied from the supplying opening 29*a* are disintegrated while they pass through the second gap 6. The mixture that has passed through the second gap 6 flows into the buffering space 8, and then the mixture is retained there while it is being pushed against the wall 10 by centrifugal force. Coarse and massive grains in the mixture retained in the buffering space 8 are selectively pushed against and rubbed with the buffering-space-defining surface 16 of the wall 10 by centrifugal force while the wall 10, which is a part of the rotor 2, rotates. Thereby the aggregates are disintegrated and dispersed. Small grains are led from the buffering space 8 to the first gap 5 by the discharged flow. The grains are more finely dispersed because the first gap 5 is narrower than the second gap 6.

Dispersing grains in the buffering space 8 can be made more efficient by controlling the frequency of the rotation of the rotor 2 to change the centrifugal force, or by adjusting the inflow of the mixture. For example, to suppress the dispersion, the centrifugal force and shearing force may be reduced by decreasing the rotational frequency of the rotor 2. Or, the movement of the coarse grains toward the surface of the outer circumferential wall (wall 10) of the buffering space 8 due to centrifugal force may be suppressed by increasing the input of the mixture. This is because the inflowing mixture is vigorously mixed with the mixture that has previously flowed into, and is retained in, the buffering space 8 such that the retention times of the mixtures are reduced. This is because the mixture flows into the buffering space 8 at a higher speed and at a higher flow rate from the second gap 6. Incidentally, if the time to retain the grains is reduced, the time during which the mixture undergoes shear energy is also reduced. So, it also suppresses the dispersion. In contrast, to promote the dispersion, the rotational frequency of the rotor 2 may be raised to increase the centrifugal force and shearing force. Or, the amount supplied of the mixture (the amount discharged from the pump) may be reduced to restrict the amount of the mixture flowing into the disperser such that the effect caused by centrifugal force is increased. Or, the time during which the grains undergo the shear energy may be shortened.

The disperser 1 of the present invention exerts a local dispersing effect caused by the shearing force generated while the mixture 4 passes through the first and the second gaps 5, 6 and a dispersing effect caused by retaining the mixture 4 in the buffering space 8 to make it homogenized. In addition to them, the disperser 1 can give a dispersing effect by pushing the mixture 4 to be rubbed against the outer circumferential wall 10 of the rotor 2 of the buffering space 8 by the centrifugal force acting against the mixture retained in the buffering space 8 connected to the first gap 5, which is the outermost gap. In this way, the disperser 1 achieves a more efficient and more appropriate dispersion.

Further, in comparison to the below-stated dispersers in FIGS. 2 and 3, the disperser 1 in FIG. 1 can improve the yield, because the raw materials can be discharged from the disperser after the operation is finished. This is because the disperser does not have any buffering space in which the raw materials can remain after the rotation of the rotor stops, and because the first and the second gaps 5, 6 each have a slope that allows the mixture to flow down and out of the disperser.

Figure 6:
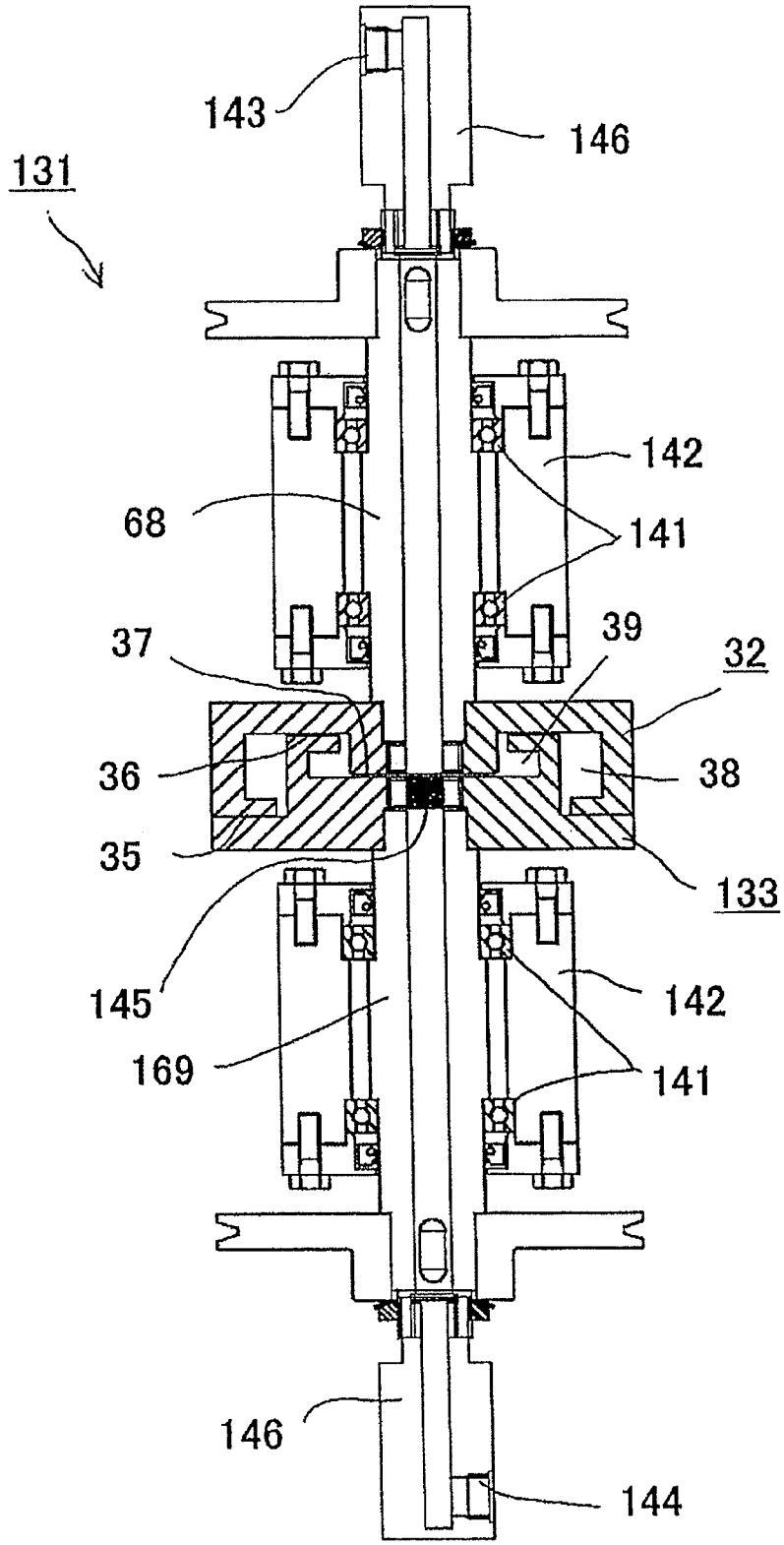
FIG. 6 is a sectional view of a more detailed configuration of the shearing disperser of FIG. 2, in which the stator is replaced by a rotor.
Figure 7:
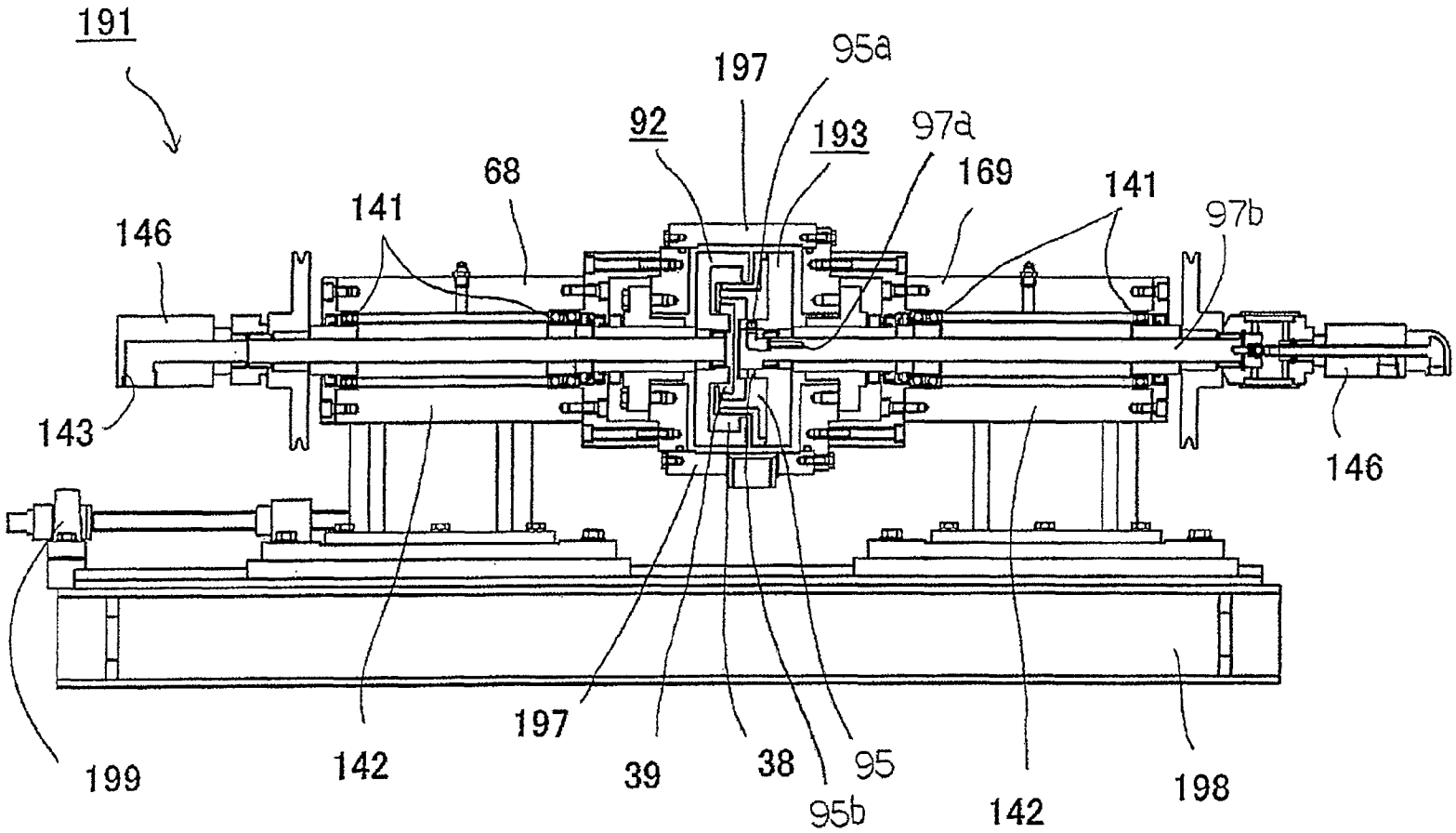
FIG. 7 is a sectional view of a detailed configuration of the shearing disperser of FIG. 5, in an example where the stator is replaced by a rotor, and the rotating shaft of the shearing disperser is horizontally disposed.

Further, the disperser 1 in FIG. 1 has the following effects. To supply a mixture from inside the rotating hollow shaft, a joint for connecting the stationary portion and the rotating shaft, such as the below-stated joint for the rotating shaft (the rotary joint) as in FIGS. 6 and 7, is required. The durability of the sealing part of the joint for the rotating-shaft becomes a problem when a slurry mixture consisting of a liquid material and a solid (powder) material is mixed and dispersed, though the problem seldom occurs when a plurality of liquid mixtures are mixed and dispersed. In that case, a hollow shaft where a raw material is supplied is preferably used as a stationary stator. By the way, if the buffering space is defined by the stator, i.e., if the outer circumferential wall of the buffering space exists on the stator, the shearing mechanism in the buffering space may not work well because no centrifugal force is generated at the stator. So, the disperser 1 in FIG. 1 may be configured such that the rotor 2 defines the buffering space 8. Namely, the outer circumferential wall 10, which defines the buffering space 8, may be provided on the rotor 2. Also, the stator 3, which has a mixture-supplying opening 29*a*, may be disposed at a lower position. Thereby the various effects described above can be achieved.

Incidentally, in the above explanation, the rotating shaft of the rotor 2 is parallel to the vertical direction. However, the disperser is not limited to this configuration. The rotor 2 and the opposing member (stator 3) may be disposed such that the rotating shaft of the rotor 2 is parallel to the horizontal direction. In this way, the disperser can be installed even if it is difficult to vertically dispose the rotating shaft of the rotor 2. However, the configuration where the shaft is vertically disposed as in FIG. 1 is advantageous in terms of the yield of the disperser, because the disperser has an effect to discharge the mixture after the dispersion is completed, as described above.

Further, in the above explanation, the rotor 2 and the stator 3 were used in combination. However, the disperser may have a pair of rotors instead of them. Namely, the opposing member that is opposite the rotor 2 may be replaced by a second rotor that has a rotating shaft parallel to the rotating shaft of the rotor 2 and that rotates in a direction opposite the direction of the rotation of the rotor 2. If a pair of rotors are used, the shearing force in those gaps is increased by the relative rotations of the rotors rotating in opposite directions. However, if a highly concentrated slurry mixture is processed, the combination of the rotor 2 and the stator 3, as given above, is advantageous, because there is no possibility for adversely affecting the sealing part of the joint for the rotating shaft.

The rotor 2 and the opposing member (stator 3) are not limited to the configuration in FIG. 1. An example where the disperser has two gaps and one buffering space was explained. However, as in FIG. 2, another buffering space may be added. Namely, the disperser may have three gaps and two buffering spaces.

Next, the shearing disperser (hereafter, a "disperser") 31 of the present invention in FIG. 2 will be described. The disperser 31 comprises a rotor 32 and a stator 33 that is opposite it. The disperser disperses a slurry or liquid mixture 4 by allowing the mixture to pass through the disperser and outward between the rotor 32 and the opposing member (stator 33) by centrifugal force.

The disperser 31 comprises a first gap 35, a second gap 36, and a third gap 37, as a plurality of gaps, and a first buffering space 38 and a second buffering space 39. The plurality of gaps (the first, the second, and the third gaps 35, 36, 37) are defined between the rotor 32 and the stator 33 and lead the mixture 4 outward. The first gap 35 is provided at an outer circumferential position. The third gap 37 is provided at the side of the center of the rotation. The second gap 36 is provided in the middle. The first buffering space 38 is provided such that it connects an outermost gap (the first gap 35) and a gap located in a position inward from the outermost gap (the second gap 36) and retains the mixture 4. The outer circumferential wall 40, which defines the first buffering space 38, is provided on the rotor 32.

Figure 2:
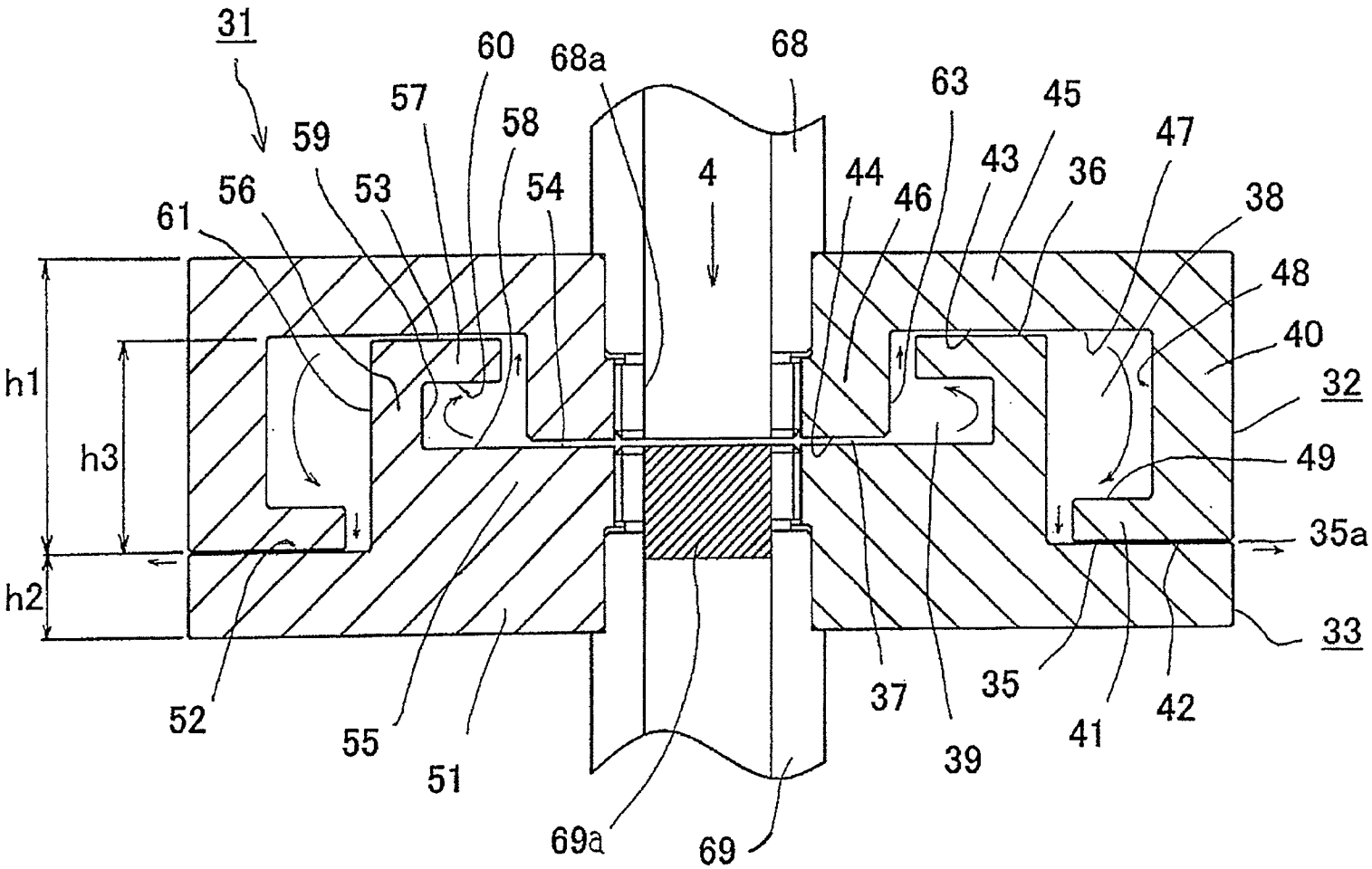
FIG. 2 is a schematic sectional view of another example of the shearing disperser.

The disperser 31 in FIG. 2 has the second buffering space 39. That space 39 connects a gap (the second gap 36) that is located in a position inward from an outermost gap (the first gap 35) to a gap located in a more inward position (the third gap 37). The second buffering space 39 retains the mixture 4. The second buffering space 39 can improve the dispersing effect because it has an effect to improve the equalizing function. Further, in the disperser 31, the opposing member (stator 33) may also be replaced by another rotor. The rotor works synergistically with the second buffering space 39. Namely, if the stator 33, which is an opposing member, is rotated as a "rotor," the dispersing effect, in the second buffering space 39, can also be improved due to the increased shearing force caused by the above force pressing against the wall, as in the buffering space 8 and the buffering space 38.

The outer circumferential wall 40, which is provided on the rotor 32 and defines the first buffering space 38, has a projecting member 41 that extends toward the center of the rotation along the end facing the opposing member (stator 33). The rotor 32 has flat gap-defining surfaces 42, 43, 44 for defining the first, the second, and the third gaps 35, 36, 37. Specifically, the rotor 32 has a disc-like rotor body 45, the wall 40, and a wall 46. The rotor body 45 is integrally attached to the rotating shaft 68. The wall 40 stands at an outer circumferential position of the rotor body 45 and in the direction of the stator 33. The wall 46 stands at an inner circumferential position. The outer side of the wall 46 serves as a surface for defining a buffering space 63 that defines the inner circumferential side of the second buffering space 39. The gap-defining surface 44 is formed on the surface, in the direction of the stator 33, of the wall 46. The gap-defining surface 43 is provided on the surface, in the direction of the stator 33, of the rotor body 45. The outer circumferential part of the gap-defining surface 43 serves as a surface for defining a buffering space 47 that defines the upper side of the first buffering space 38. The inner side of the wall 40 serves as a surface for defining a buffering space 48 that defines the outer side of the first buffering space 38. The surface for defining a gap 42, which defines the first gap 35, is provided toward the stator 33 and on the projecting member 41, which is formed to continue to the wall 40. A surface for defining a buffering space 49, which defines the lower side of the first buffering space 38, is provided on the opposite (upper) side of the projecting member 41.

The stator 33 has flat gap-defining surfaces 52, 53, 54 for forming the first, the second, and the third gaps 35, 36, 37. Specifically, the stator 33 comprises a disc-like stator body 51, a step 55, and a wall 56. The disc-like stator body 51 is integrally attached to an axial member 69. The step 55 rises toward the rotor 32 and at an inner circumferential position of the stator body 51. The height of the wall 56 increases at an outer circumferential position on the step 55. The wall 56 defines the outer circumference of the second buffering space 39. The wall 56 has a projecting member 57 that extends toward the center of the rotation along the end in the direction of the rotor 32. The gap-defining surface 54 is provided on the upper surface of the step 55. The outer side of the gap-defining surface 54 serves as a surface for defining a buffering space 58 that defines the lower side of the second buffering space 39. The inner side of the wall 56 serves as a surface 59 for defining a buffering space that defines the outer circumferential side of the second buffering space 39. The surface 53 for defining a gap is provided on the projecting member 57 and toward the rotor 32. A surface for defining a buffering space 60 that defines the upper side of the second buffering space 39 is provided on the opposite side (lower side) of the projecting member 57. The outer side of the wall 56 serves as a surface for defining a buffering space 61 that defines the inner circumferential side of the first buffering space 38. The gap-defining surface 52 is provided on the outer circumferential side of the stator body 51 and toward the rotor 32. By the way, the projecting members 41, 57, which are provided on the rotor 32 and the stator 33, have a function to increase the local shearing force by making the lengths of the respective gaps (in this context, the first gap 35 and the second gap 36) longer, to have the mixture flowing into the buffering space detour. Incidentally, the projecting member 11 of FIG. 1 also has the same function.

The plurality of gaps has a relationship in which a gap located in an outer circumferential position is narrower than a gap located in an inner circumferential position. Namely, the gap-defining surfaces 42, 43, 44, 52, 53, 54 are each formed such that the first gap 35 is narrower than the second gap 36 and the second gap 36 is narrower than the third gap 37. Also, the first, the second, and the third gaps 35, 36, 37 are each formed to be 2 mm wide or less between the rotor 32 and the stator 33. Below the effect caused by this relationship is explained. The widths of the respective gaps may the same. In that case, the effects of the present invention other than the effects caused by using the above configuration can be achieved.

For example, if the widths of the rotor 32 and the stator 33 are 200 mm, and the heights h1, h2, and h3 are 55 mm, 16 mm, and 39.5 mm respectively in the disperser 31 in the figure, the first gap 35 is 0.5 mm wide, the second gap 36 is 1.0 mm wide, and the third gap 37 is 1.5 mm wide. The gaps become narrower outwardly in a phased way. The rotational frequency can be set at about 0-3,600 rpm by an inverter control. However, the rotational frequency may be appropriately changed by selecting a motor, a pulley, a gear, etc.

The flow of the mixture is shown by the arrows in FIG. 2. For convenience, only one flow is shown. Actually, similar flows are caused throughout the space defined by the rotor 31 and the stator 32. If a mixture is supplied by gravity or by means of a pump, etc., from the mixture-supplying opening of a rotary joint into the rotating shaft 68 while the rotor 31 is rotating, the mixture 4 passes through the third gap 37, the second buffering space 39, the second gap 36, the first buffering space 38, and the first gap 35, in this order, along the direction of the centrifugal force. Then the mixture 4 is discharged from the mixture-discharging outlet 35*a* at the outer circumferences of the rotor 31 and the stator 32. The mixture-discharging outlet 35*a* is the outer end of the first gap 35. In this way, the first, the second, and the third gaps 35, 36, 37, and the first and the second buffering spaces 38, 39 are provided between the rotor and the opposing member such that they configure a plurality of gaps that lead a mixture outward and a buffering space that is provided to connect an outermost gap and a gap located in a position inward from the outermost gap and that retains the mixture. They cause a dispersing effect by a local shearing function and a dispersing effect by an equalizing function, respectively. In other words, the above configuration is a defined space through which a mixture can pass from its center to its outer side between a rotor and an opposing member. The space is formed by alternately disposing one or more narrow spaces, each 2 mm wide or less (these spaces correspond to the gap) and one or more wide spaces wider than the narrow spaces (these spaces correspond to the buffering space). The narrow spaces cause the local shearing function, and the wide spaces cause the equalizing function. Incidentally, the flow of the mixture and the functions of the respective gaps and respective buffering spaces are the same in the disperser of FIG. 1 and in the following dispersers, in FIGS. 3 to 7.

The rotor 32 and the opposing member (stator 33) are disposed such that the rotating shaft of the rotor 32 is vertical and such that the opposing member (stator 33) is located in a lower position. The disperser 31 can increase the yield in the dispersion, because it can discharge the mixture remaining in the first buffering space 38, which has a large volume, without disassembling the disperser after the dispersion is completed.

The opposing member (stator 33) is formed such that a part of the opposing member, which part defines the first, the second, and the third gaps 35, 36, 37, is horizontal. However, the opposing member may be formed to slope downward toward its outer circumference as in the example explained with reference to FIG. 1. If the opposing member is configured as in FIG. 1, the yield can be increased because the mixture can be discharged after the process is completed.

A supplying opening 68*a* from which the mixture 4 is supplied is formed on the rotating shaft 68 of the rotor 32. Specifically, the rotating shaft 68 is formed as a cylinder, and the mixture 4 is supplied through its inside. The axial member 69 of the stator 33 is also formed as a cylinder, and an occluding member 69*a* is provided at its tip. Incidentally, the supplying opening is not limited to this configuration. The supplying opening that can supply the mixture 4 from the center of the rotation (of the rotor 32) may be provided on the rotor 32 or the opposing member (stator 33) or on both of them. However, if a slurry mixture having a high concentration of solids, etc., is dispersed and the durability of the sealing member may be impaired, it is advantageous to configure the supplying opening such that the mixture is supplied from a supplying opening that is provided at the center of the stator 33, as was explained with reference to FIG. 1.

The dispersion by means of the above dispersers 31 will now be explained. First, aggregates of coarse grains are disintegrated while the mixture supplied by the supplying opening 68*a* passes through the third gap 37, which serves as a first-step gap. The mixture that has passed through the third gap 37 flows into the second buffering space 39, which serves as a first-step buffering space. Then the mixture is retained there while it is pushed against the wall 56 by centrifugal force. Then aggregates of grains are further disintegrated while the mixture passes through the second gap 36, which serves as a second-step gap. The dispersed mixture in the second gap 36 is smaller, because the second gap 36 is narrower than the third gap 37. The mixture that has passed through the second gap 36 flows into the first buffering space 38, which serves as a second-step buffering space. Then the mixture is retained there while it is pushed against the wall 40 by centrifugal force. The coarse massive grains in the mixture retained in the first buffering space 38 are selectively pushed against and rubbed against the surface for defining a buffering space 48 of the wall 40 by centrifugal force while the wall 40, which is a part of rotor 32, rotates. Thereby the aggregates are disintegrated and dispersed. Small grains are led to the first gap 35 with the flow discharged from the first buffering space 38, which serves as a third-step gap. The dispersed mixture in the first gap 35 is still smaller, because the first gap 35 is narrower than the second gap 36.

The dispersion of the grains in the buffering spaces can be more efficient by controlling the rotational frequency of the rotor 32 to change the centrifugal force and adjust the inflow of the mixture. For example, to suppress the dispersion, the centrifugal force and shearing force may be reduced by decreasing the rotational frequency of the rotor 32. Or, the movement of the coarse grains toward the surfaces of the outer circumferential walls (walls 40 and 56) of the buffering spaces 38, 39 due to the centrifugal force can be suppressed by increasing the input of the mixture, because the inflowing mixture is vigorously mixed with the mixture that has previously flowed into and is retained in the buffering spaces 38, 39 such that the retention time of the mixtures is reduced. This is because the mixtures flow from the third gap 37 to the second buffering space 39 or from the second gap 36 to the first buffering space 38 at a higher speed and at a higher flow rate. Incidentally, reducing the retention time of the mixture may also have an effect to suppress the dispersion because the reduced retention time means that the time during which the grains undergo the shear energy is also reduced. In contrast, to enhance the dispersion, the rotational frequency of the rotor 32 may be raised to increase the centrifugal force and the shearing force. Or the amount of the supply of the mixture (the amount discharged from the pump) may be reduced to restrict the mixture flowing into the disperser such the effect caused by the centrifugal force may be enhanced. Or the time during which the grains undergo the shearing energy may be increased.

The disperser 31 of the present invention exerts a local dispersing effect caused by the shearing force generated against the mixture 4 while it passes through the first, the second, and the third gaps 35, 36, 37 and a dispersing effect caused by retaining the mixture 4 in the first buffering spaces 38, 39 to equalize it. In addition, the disperser 31 can exert a dispersing effect by causing the mixture 4 to be pushed against and rubbed with the outer circumferential wall 40 of the rotor 32 in the buffering space 38 due to the centrifugal force generated against the mixture retained in the first buffering space 38, which is connected to the first gap 35, which is a gap at an outer circumferential position. In this way, the disperser 31 can achieve more efficient and appropriate dispersion.

Also, the disperser 31 can carry out a more efficient dispersion in terms of a local shearing dispersing effect and an equalizing dispersing effect, because it has three gaps and has two buffering spaces.

Incidentally, in the above description, the rotating shaft of the rotor 32 is disposed to be parallel to the vertical direction. However, the rotor is not limited to this direction. The rotor 32 and the opposing member (stator 33) may be disposed such that the rotating shaft of the rotor 32 is parallel to the horizontal direction.

Further, as in the above description, the rotor 32 and the stator 33 were used in combination. However, they may be replaced by a pair of rotors. Namely, the opposing member that opposes the rotor 32 may be replaced by a second rotor that has a rotating shaft parallel to the rotating shaft of the rotor 32 and that rotates in a direction opposite to the direction of the rotation of the rotor 32. If the rotor and the stator in FIG. 2 are replaced by a pair of rotors, the shearing force in the gaps can be exerted by the rotors rotating in opposite directions. In addition, an effect to cause the mixture to be pushed against and rubbed with the surface of the wall 56 can also be achieved by rotating the outer circumferential wall 56, which defines the second buffering space 39. So, a further dispersing effect is achieved in the area. Accordingly, a more efficient and appropriate dispersion is achieved.

Incidentally, the shape of the buffering space is not limited to the rectangular section as in FIG. 2. For example, it may be formed to have a shape in which its outer circumferential surface slopes downward as in FIG. 3. This provides an advantage in manufacturing the disperser.

Next, the shearing disperser (hereafter, the "disperser") 71 of the present invention in FIG. 3 will be explained. The disperser 71 comprises a rotor 72, and a stator 73 that is an opposing member disposed to oppose the rotor 72, wherein the disperser disperses a slurry or liquid mixture 4 by allowing it to pass through the disperser and outward between the rotor 72 and an opposing member (stator 73).

The disperser 71 comprises a first gap 75, a second gap 76, and a third gap 77, as a plurality of gaps, and a first buffering space 78 and a second buffering space 79. The plurality of gaps (the first, the second, and the third gaps 75, 76, 77) are provided between the rotor 72 and the stator 73 and lead the mixture 4 outward. The first gap 75 is provided at an outer circumferential position, the third gap 77 is provided at the side of the center of the rotation, and the second gap 76 is provided in the middle. A first buffering space 78 is provided such that it connects an outermost gap (the first gap 75) and a gap located in a position inward from the outermost gap (the second gap 76). It retains the mixture 4. An outer circumferential wall 80 that defines the first buffering space 78 is provided on the rotor 72.

Figure 3:
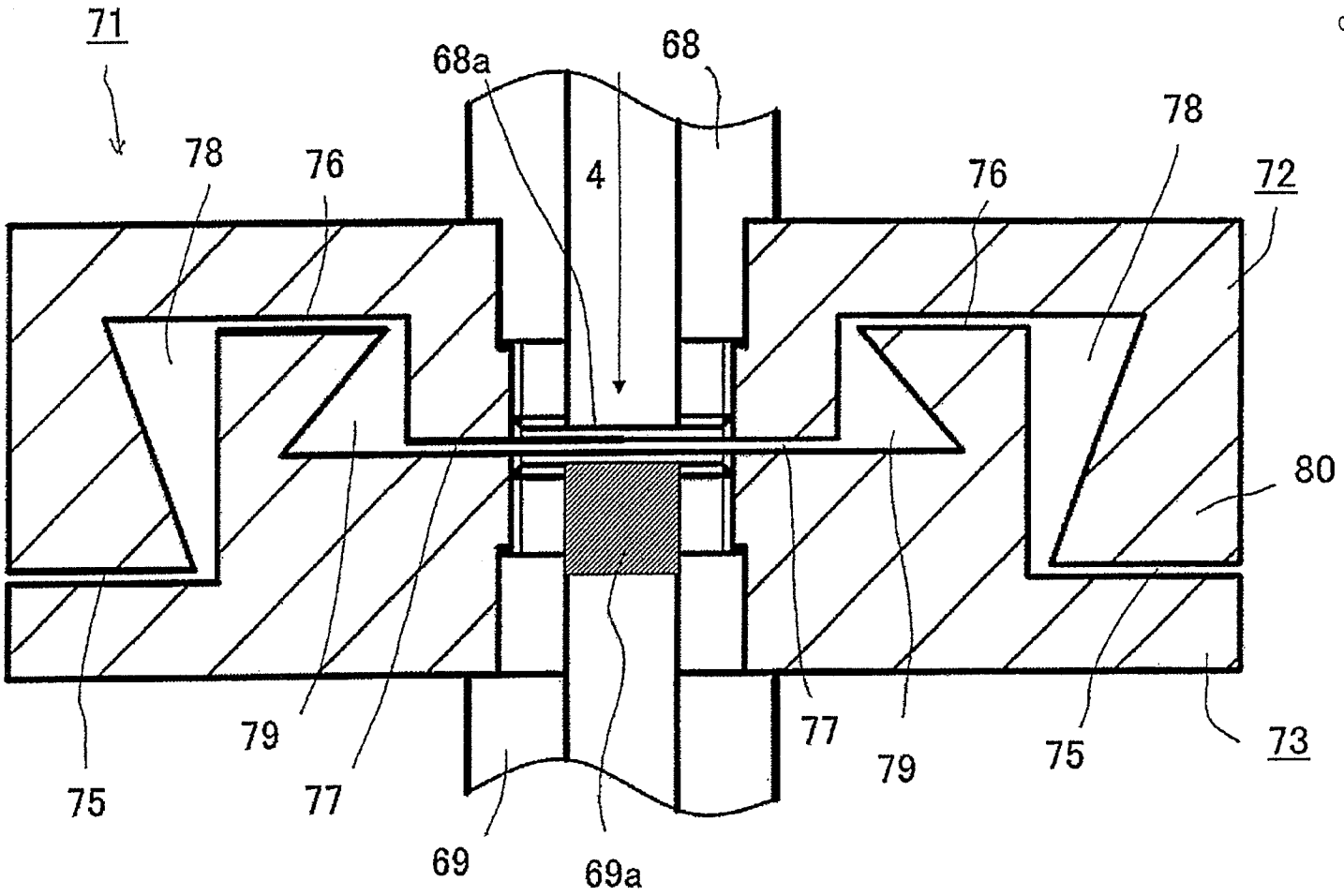
FIG. 3 is a schematic sectional view of yet another example of the shearing disperser.

The disperser 71 in FIG. 3 comprises a second buffering space 79. The second buffering space 79 is provided such that it connects a gap (the second gap 76) located in a position inward from an outermost gap (the first gap 75) and a gap (the third gap 77) located in a position inward from the second gap. The second buffering space 79 retains the mixture 4. This second buffering space 79 can improve the dispersing effect because it has a function to improve an equalizing function. Further, also in the disperser 71, the opposing member (stator 74) may be replaced by another rotor. In that case, the rotor can work synergistically with the second buffering space 79.

A plurality of gaps have a relationship in which a gap located in an outer circumferential position is narrower than a gap located in an inner circumferential position. Namely, each gap-defining surface is formed such that the first gap 75 is narrower than the second gap 76, and the second gap 76 is narrower than the third gap 77. Also, the first, the second, and the third gaps 75, 76, 77 are provided to each have a width of 2 mm or less between the rotor 72 and the stator 73. The dispersion by means of the above dispersers 71 will not be explained in detail since the process is substantially the same as that carried out by means of the disperser 31 in FIG. 2.

The disperser 71 of the present invention exerts a local dispersing function caused by the shearing force generated against the mixture 4 while it passes through the first, the second, and the third gaps 75, 76, 77, and a dispersing function caused by retaining the mixture 4 in the first buffering space 78 and the second buffering space 79 to make the mixture 4 homogenized. In addition to them, the disperser 71 causes the mixture 4 to be pushed against and rubbed with the outer circumferential wall 80 of the rotor 72 in the buffering space 78 due to the centrifugal force generated against the mixture retained in the first buffering space 78 connected to the first gap 75, which is an outer circumferential gap. So, a further dispersing effect is achieved in the area. In this way, the disperser 71 can carry out a more efficient and appropriate dispersion.

In FIGS. 1, 2, and 3, there are two or three gaps for generating a shearing force, and there are one or two buffering spaces. However, they are not necessarily limited to this combination of the gaps and spaces. They may be a combination of any number of gaps and spaces, depending on the raw material to be processed or on the desired degree of dispersion.

The dispersers 1, 31, 71, as explained with reference to FIGS. 1, 2, and 3, may be configured such that the rotor or the opposing member or both of them have a coolant-circulating-space in which a coolant for cooling the mixture between the rotor and the opposing member circulates. In other words, the mixture is heated due to the strong shearing force while it passes through the gaps between the pair of rotors or between the rotor and the stator, or while it is rubbed against the inside wall of the buffering space while the mixture is retained by the buffering space. The heat can be a problem if a mixture that can be denatured by an increased temperature, etc., is processed. The heat generated may be decreased by installing the above coolant-circulating-space, namely, by configuring the rotor and the stator to have a jacket structure such that the coolant passes through a hollow shaft or a separate pipe.

Next, a disperser 81 in FIG. 4, which is given as a modified example of the disperser in FIG. 1, and a disperser 91 in FIG. 5, which is given as a modified example of the disperser in FIG. 2, will be explained as examples where the coolant-circulating-space is used. Incidentally, the components, each having the same configuration and the same function, are shown by the same numerals without being explained in detail, since the disperser is substantially the same as the dispersers explained with reference to FIGS. 1 and 2, except that the coolant-circulating-space is provided (they are shown in the same way in the other figures).

Figure 4:
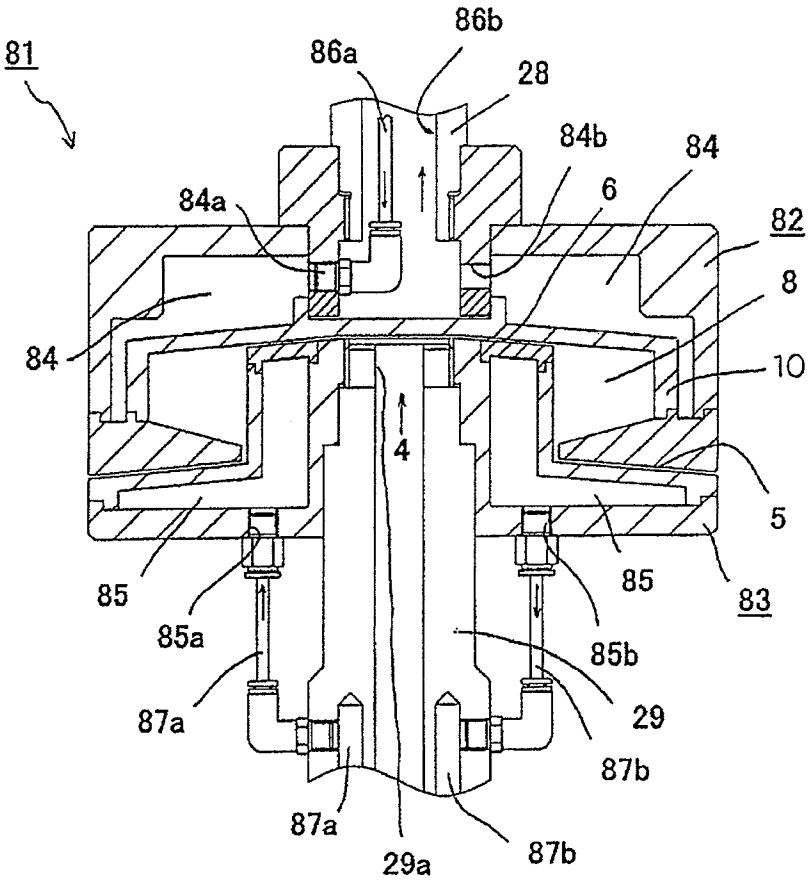
FIG. 4 is a schematic sectional view of a modified example of the shearing disperser of FIG. 1.

The disperser 81 in FIG. 4 comprises a rotor 82 and a stator 83, which are configured in the same way as the rotor 2 and the stator 3 in FIG. 1, except that they have coolant-circulating-spaces 84, 85. The disperser 81 disperses a slurry or liquid mixture 4 by allowing the mixture to pass through the disperser and outward between the rotor 82 and the opposing member (stator 83) by centrifugal force. Namely, the rotor 82 and the stator 83 have the first and the second gaps 5, 6, the buffering space 8, the wall 10, etc.

The rotor 82 has the coolant-circulating-space 84, in which a coolant circulates, the coolant-supplying inlet 84*a*, and the coolant-discharging outlet 84*b*. A supplying pipe 86*a* and a discharging pipe 86*b* are respectively connected to the inlet 84*a* and the outlet 84*b*. The stator 83 has the coolant-circulating-space 85, in which a coolant circulates, the coolant-supplying inlet 85*a*, and the coolant-discharging outlet 85*b*. A supplying pipe 87*a* and a discharging pipe 87*b* are respectively connected to the inlet 85*a* and the outlet 85*b*.

Figure 5:
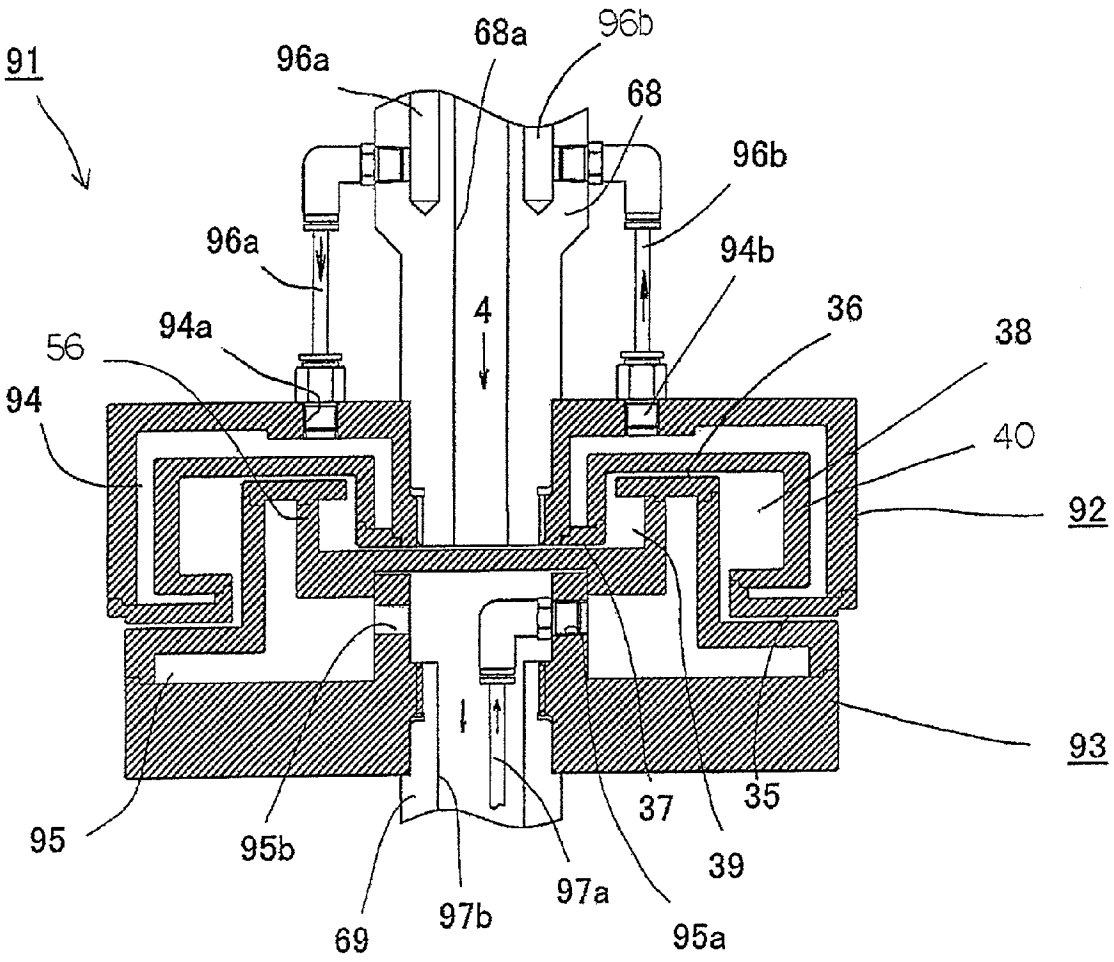
FIG. 5 is a schematic sectional view of a modified example of the shearing disperser of FIG. 2.

Similarly, the disperser 91 in FIG. 5 comprises a rotor 92 and a stator 93, which are configured in the same way as the rotor 32 and the stator 33 in FIG. 2, except that they have coolant-circulating-spaces 94, 95. The disperser 91 disperses a slurry or liquid mixture 4 by allowing the mixture to pass through the disperser and outwardly between the rotor 92 and the opposing member (stator 93) by centrifugal force. Namely, the rotor 92 and the stator 93 have the first, the second, and the third gaps 35, 36, 37, the buffering spaces 38, 39, the wall 40, etc.

The rotor 92 has the coolant-circulating-space 94, in which a coolant circulates, the coolant-supplying inlet 94*a*, and the coolant-discharging outlet 94*b*. A supplying pipe 96*a* and a discharging pipe 96*b* are respectively connected to the inlet 94*a* and the outlet 94*b*. The stator 93 has the coolant-circulating-space 95, in which a coolant circulates, the coolant-supplying inlet 95*a*, and the coolant-discharging outlet 95*b*. A supplying pipe 97*a* and a discharging pipe 97*b* are respectively connected to them.

The dispersers 81, 91 in FIGS. 4 and 5 exert the same effects as those of the above disperser 1 in FIG. 1 and the disperser 31 in FIG. 3 such that the dispersers 81, 91 can achieve a more efficient and appropriate performance in the dispersion. In addition, the dispersers can prevent the mixture from being denatured by cooling the heat generated by the shearing force since the dispersers have the coolant-circulating-spaces 84, 85, 94, 95, in which a coolant circulates.

Hereafter, the concrete configurations, such as a bearing member, etc., of the above dispersers will be explained with reference to FIGS. 6 and 7. A modified example where the stator 33 of the disperser 31 in FIG. 2 is replaced by a rotor 133 that serves as a rotating component (the disperser will be referred to as "disperser 131") will be explained with reference to FIG. 6. Incidentally, the configuration and the shape of each component of the rotor 133 are the same as those of the stator 33. The disperser 131 in FIG. 6 is installed such that the two rotors 32,133, which each have concavities and convexities, share a rotating central axis, and such that the rotors oppose each other along the vertical direction. As in the above disperser 31, the disperser 131 has the first, the second, and the third gaps 35, 36, 37, and the first and the second buffering spaces 38, 39, which spaces each have a rectangular section, based on the combination of the concavities and the convexities of each rotor.

The pair of the rotors 32, 133 are connected to the rotating shafts 68, 169, respectively. The rotating shafts 68, 169 are each supported by bearing boxes 142 that are each strongly fixed through bearings 141 to the shafts (the method for fixation is not shown). The rotating shafts 68, 169 are driven by an electric motor connected to a belt, a chain, a gear, etc. (the electric motor is not shown). The shafts rotate in opposite directions. In this disperser, the rotating shafts 68, 169 rotate clockwise as seen from the mixture-supplied openings 143, 144. The frequency of the rotations may be set at any value depending on the raw material to be processed or the desired degree of dispersion. Incidentally, the tip of the hollow shaft 169 is occluded by a plug 145 to prevent the mixture from flowing into the tip and out from the tip. The mixture-supplied openings 143, 144 are connected to the rotating shafts 68, 169 via the rotary joints 146.

Incidentally, the plug 145 of the hollow shaft 169 may be removed to supply other raw material from the mixture-supplying opening 144 such that the rotors mix the raw material with a raw material supplied from the mixture-supplied opening 143. In this case, a pump for the supplying opening 144 is required. Also, in this disperser, the two rotating shafts 68, 169 are separately driven by respective electric motors. However, the driving power of one electric motor may be distributed by means of a gear to drive both rotating shafts.

The detailed configuration of a modified example where the stator 93 of the disperser 91 in FIG. 5 is replaced by a rotor 193 that serves as a rotating component (the disperser will be referred to as the "disperser 191") is configured as in FIG. 7. The disperser 191 is an example where the rotating shafts of the rotors 92, 193 are disposed to be parallel to the horizontal direction. In FIG. 7, as in FIG. 6, the bearing 141, the bearing boxes 142, the mixture-supplied opening 143, and the rotary joint 146, are illustrated. Also, a rotor cover 197 for leading a processed mixture to the following step is illustrated. Further, a cradle 198 for the entire apparatus and a motor 199 for driving the rotors 92, 193 are illustrated. Incidentally, the rotor 92 in FIG. 7 does not have the coolant-circulating-space 94. However, the rotor may have a coolant-circulating-space as in FIG. 5.

The disperser 131 in FIG. 6 and the disperser 191 in FIG. 7 show the specific configurations of the bearings, etc., of the dispersers. The dispersers exert the same effects as those of the dispersers 31, 91 in FIGS. 2 and 5, because the dispersers 131, 191 are examples where the stators of the dispersers 31, 91 are merely replaced by rotors. Each disperser in FIGS. 1, 3, and 4 also has a configuration where the same bearing, etc is used. Incidentally, if a rotor and a stator are used in combination as explained with reference to FIGS. 1 to 5, the configuration can be simplified, because no bearing 141 or rotary joint 146 is required for the stator.

Figure 8:
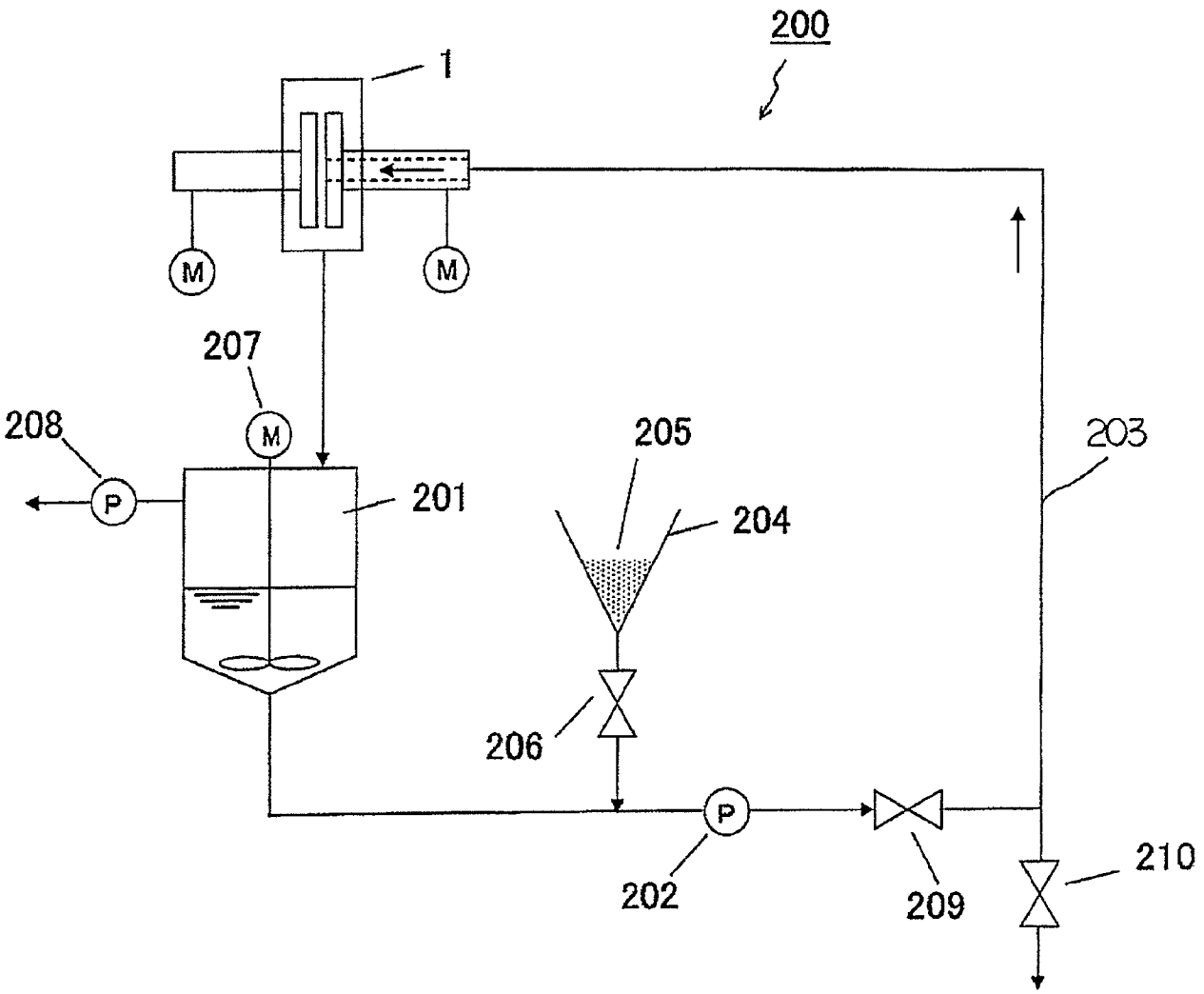
FIG. 8 is a schematic figure of the configuration of the circulation-type dispersing system of the present invention.

Next, an example of a circulation-type dispersing system by using the above disperser is explained with reference to FIG. 8. The circulation-type dispersing system 200 in FIG. 8 comprises a rotor-type continuous-type disperser for dispersing the mixture 4. (The disperser may be any of the dispersers 1, 31, 71, 81, 91, 131, 191 in FIGS. 1 to 7, etc.; a disperser in which a stator is replaced by another rotor is also included). Hereafter the disperser will be referred to as "disperser 1, etc." The figure, in which M represents a motor, shows an example where the stator of the disperser 1 is replaced by another rotor and the disperser is installed horizontally. However, as explained above, the system is not limited to this. Also, the circulation-type dispersing system 200 comprises the following: a tank 201 that is connected to an outlet side of the disperser 1, etc.,; a circulating pump 202 that is connected to an outlet side of the tank 201 and that circulates the mixture 4; and a pipe 203 for connecting in sequence the disperser 1, etc., the tank 201, and the circulating pump 202.

Incidentally, the fluid that circulates inside the tank 201, the disperser, and the pipe 203 is initially a raw material. The added raw material is gradually dispersed each time the mixture passes through the disperser, and then finally becomes a fully dispersed mixture. In the above and the following explanation, the initial "raw material" and the "mixture" in the middle of the process are both referred to as a "mixture."

The circulation-type dispersing system 200 is equipped with a feeder 206 in a position in the pipe for circulation. The feeder 206 pours an additive 205 (a liquid or a particulate material) stored in the hopper 204 into the circulating mixture (the mixture is initially a raw material). The mixture that is dispersed by the disperser 1, etc., is brought back into the tank 201 by gravity. Segregation, etc., of the mixture in the tank 201 is prevented by the agitation of an agitator 207.

A vacuum pump 208 is connected to the tank 201. If the amount discharged from the disperser 1, etc., is not sufficient, the vacuum pump 208 can decompress the inside of the tank to assist the discharge. Also, the decompression by means of the vacuum pump 208 may work also in a defoaming process if foam is mixed in the mixture.

In the above circulation-type dispersing system 200, a bulb 209 is always open and a bulb 210 is always closed, during the process. The bulb 209 is closed and the bulb 210 is opened when the dispersion is finished. Thereby processed materials can be discharged and collected from the bulb 210.

The system has the disperser 1, etc., as in FIGS. 1 to 7. Thereby the circulation-type dispersing system 200 can carry out an efficient and appropriate dispersion. Thus the entire system also shortens the time for the dispersion while the performance in the dispersion is improved at the same time.

Next, an experimental example by using the disperser is explained. In this experimental example, the disperser 191, in which the pair of the rotors 92, 193 are installed horizontally as explained above with reference to FIG. 7, was used. To carry out a dispersing test, the disperser was used in the circulation-type dispersing system 200. The tank 201, which serves as the buffer tank in FIG. 8, and the circulating pump 202 for sending liquid, were connected to the system. The rotor was made of SUS304 (stainless steel). The multistage rotor in FIG. 2 or 5 (hereafter, it will be referred to as a "multistage rotor") was used. In the disperser used in this experimental example, the three gaps between the rotors (the first, the second, and the third gaps 35, 36, 37) were the same. Their widths were each about 0.39 mm. The shearing area (the total area of the gaps between the rotors) was about 271 $cm^2$. This disperser was incorporated into the circulation-type dispersing system as in FIG. 8, and the dispersion was repeated. As a material, 10 weight percent of Aerosil #200 (a product from Japanese Aerosil, Inc.) was added to distilled water. The procedure of the dispersing test will now be explained. First, a specific amount of distilled water was added to the tank for storing raw materials, and then the pump was started to start the circulation while the rotor was stopped. Next, the entire system was negatively pressured by decompressing the tank for storing raw materials by means of the vacuum pump. Thereby the Aerosil #200 was intermittently vacuumed and supplied from the pipe located between the tank and the pump. The dispersion was carried out by rotating the rotor from the initial state, i.e., when the supply of the Aerosil #200 is finished.

Figure 9:
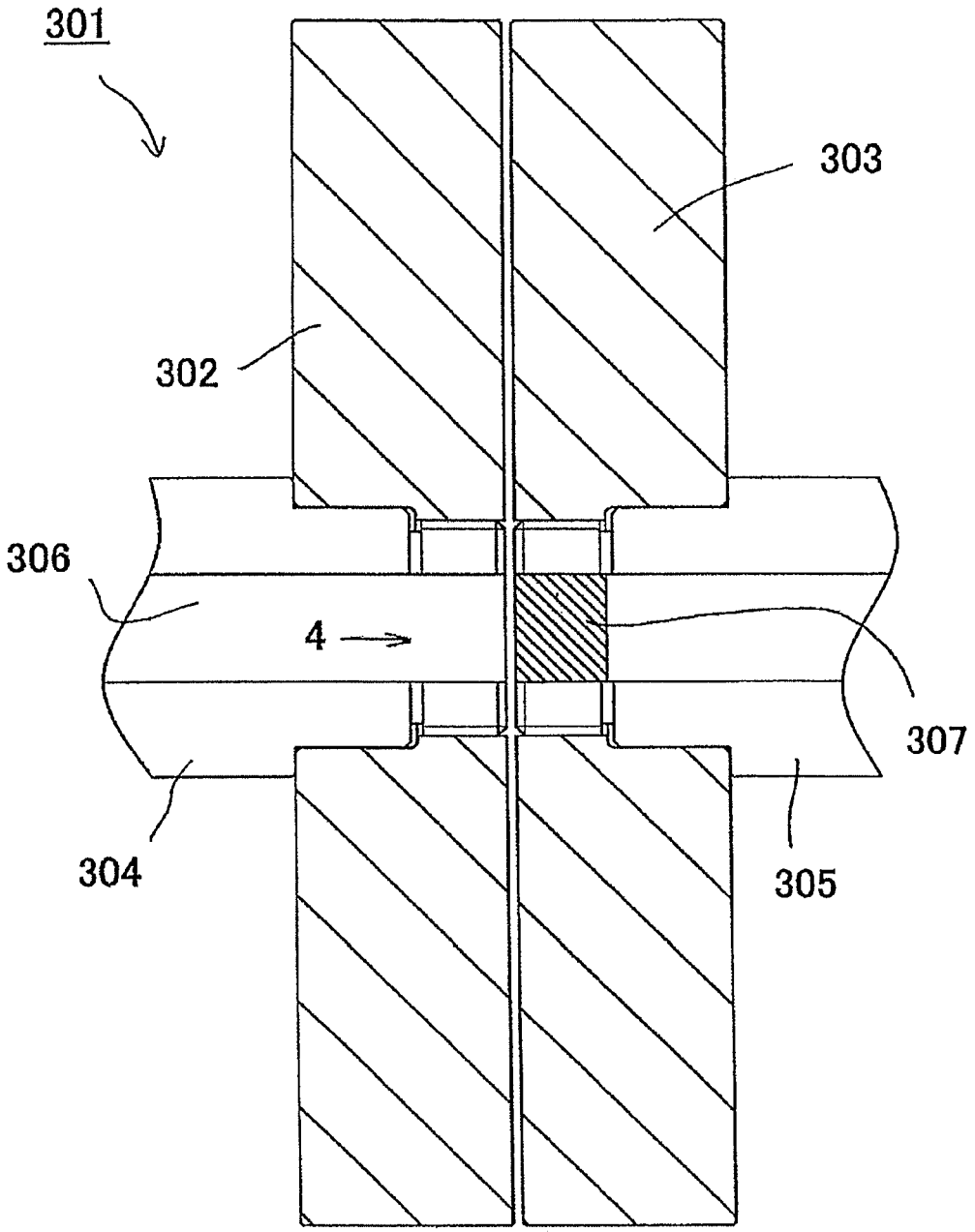
FIG. 9 is a schematic sectional view of a flat-rotor-type disperser, which is a comparative example of the shearing disperser of the present invention.

Incidentally, as a disperser to compare to the experimental example, a similar test was carried out by a disperser having flatly shaped rotors (hereafter, it will be referred to as a "flat rotor disperser") in as in FIG. 9. The flat rotor disperser 301 has a pair of rotors 302, 303, and the rotating shafts 304, 305, as in FIG. 9. A mixture-supplying member 306 is provided on the rotating shaft 304. An occluding plug 307 is provided on the rotating shaft 305. The flat rotor disperser was made of SUS304 (stainless steel) as in the multistage rotor disperser. The gap between the rotors was about 0.36 mm. The shearing area was about 304 $cm^2$.

Figure 10:
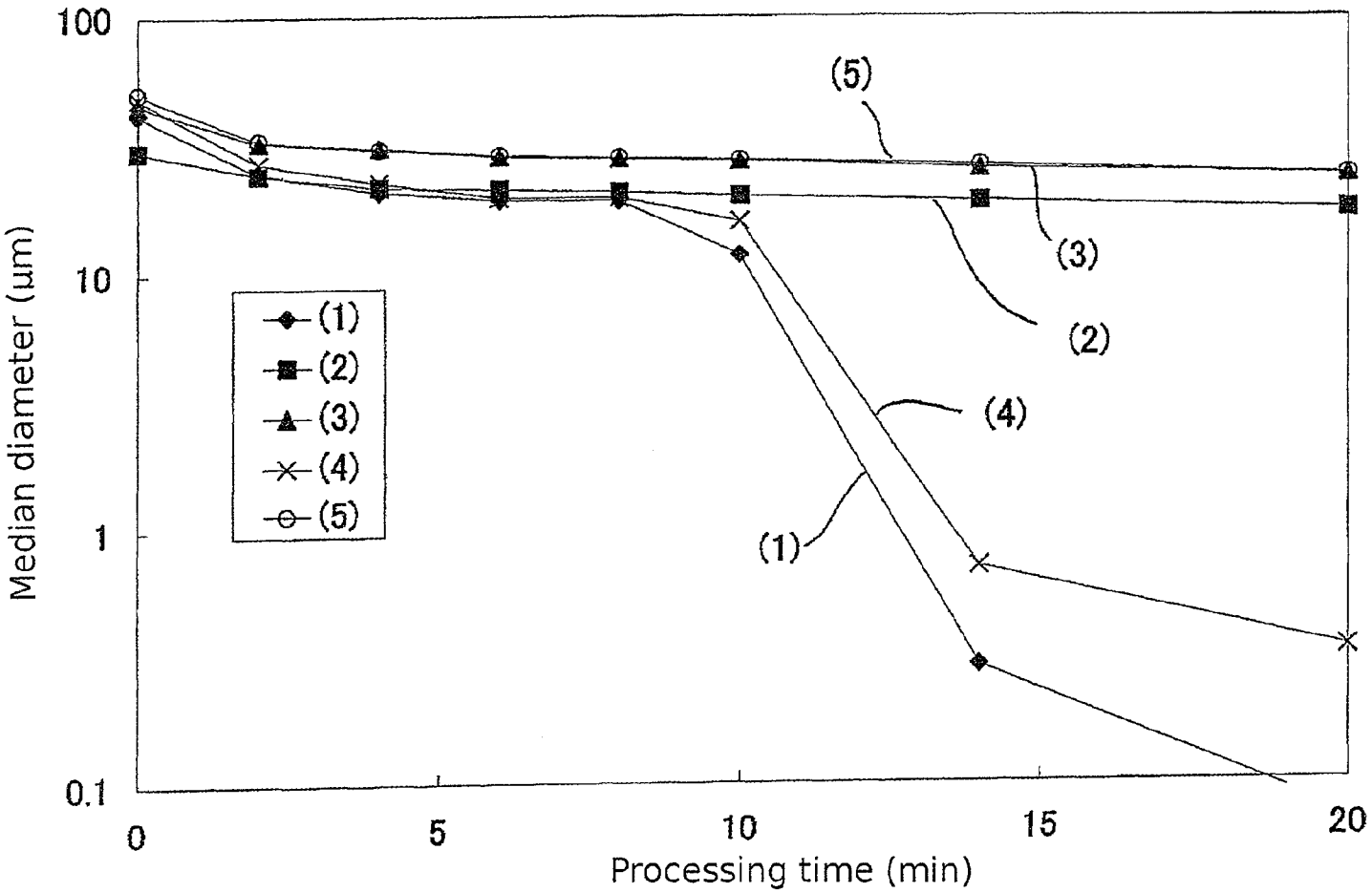
FIG. 10 is a figure illustrating the change of the median diameter in relation to the processing time by the dispersers in an example and a comparative example.

The following Table 1 shows the operating conditions for the experimental examples by using the above multistage rotors disperser (experiments (1), (2), and (3)) and the comparative examples (experiments (4) and (5)) by using the flat rotor disperser. FIG. 10 shows the change of the median diameter in relation to the processing time. The numbers (1) to (5) given to the lines in FIG. 10 correspond to the numbers in Table 1. Also, the "rotor at the supplying side" in the Table represents the rotor 92 in FIG. 7 and the rotor 302 in FIG. 9. The "rotor at the cooling side" in the Table represents the rotor 193 in FIG. 7 and the rotor 303 in FIG. 9.

TABLE 1

| Number | Type of rotor | Frequency of the rotation of the rotor at the supplying side (rpm) | Frequency of the rotation of the rotor at the cooling side (rpm) |
|---|---|---|---|
| (1) | Multistage rotor | 3000 | 3000 |
| (2) | | 3600 | 0 |
| (3) | | 0 | 3600 |
| (4) | Flat rotor | 3000 | 3000 |
| (5) | | 3600 | 0 |

The median diameters were measured by means of a laser diffraction particle-size analyzer (SALD-2100; Shimadzu). The multistage rotor disperser and the flat rotors disperser were compared by operating them at the same rotational speed (numbers (1), (4)). Then it was found that the multistage rotor disperser, which has a buffering space, reduced the median diameter faster than the flat rotor disperser when the pair of rotors were rotated in opposite directions at 3,000 rpm. Accordingly, the multistage rotor disperser seems to have better dispersing efficiency (number (1)). Further, numbers (2), (3), and (5), in which one rotor at one side was rotated, were compared. Number (2), in which a rotor that has a larger capacity in its buffering space and causes greater centrifugal force was rotated at 3,600 rpm, reduced the median diameter faster than number (3), in which a rotor that has a smaller capacity in its buffering space and causes a smaller centrifugal force was rotated at 3600 rpm, even though both dispersers had multistage rotors. The dispersing performance was the worst in number (5), in which only one flat rotor at one side was rotated.

From the above experiments, the present inventors have found the following. When a configuration of a one-sided rotor (namely, it corresponds to the combination of the rotor and the stator) was used, the dispersing effect in number (2) was better than that in number (5) and in number (3). From this, it was found that a further shearing effect was exerted by the outer walls (10, 40, etc.) formed on the rotor and at the outer sides of the buffering spaces (8, 38, etc.). Further, it was found that a centrifugal force and a shearing effect were exerted at the wall of the buffering space in addition to the local shearing effect in the plurality of gaps and the equalizing dispersing effect in the buffering space, because the dispersing performance in number (1) was much better than that in number (4) in the configuration in which the rotors at both sides rotate (namely, the configuration corresponds to a pair of rotors). The above shearing disperser of the present invention is configured to have gaps and a buffering space as described above. Thereby the disperser achieves a more efficient and appropriate dispersion.

The circulation-type dispersing method for dispersing a mixture while circulating it by means of the circulation-type dispersing system 200 comprises the following: any of the above dispersers 1, 31, 71, 81, 91, 131,191; a tank connected to an outlet side of the disperser; a pump for circulating the mixture; and a pipe for connecting in sequence the disperser, the tank, and the pump. Thereby the method achieves a more efficient and appropriate dispersion.

As stated above, the shearing disperser consisting of a rotor and a stator, or the shearing disperser consisting of a pair of rotors, wherein the respective dispersers comprise at least one buffering space, and wherein an outer circumferential wall that defines the buffering space is provided on the respective rotors, were explained with reference to FIGS. 1 to 10. In other words, explained above is a disperser that is characterized by the buffering space and the plurality of gaps being provided both inward from and outward from the buffering space and being defined by forming both concavities and convexities on the rotor and the opposing member (a stator or a rotor), wherein the gap between the rotor and the opposing member (the gap along the direction where they oppose each other) serves as a passage for leading a mixture from an inner circumferential position to an outer circumferential position (for example, a gap of about 2 mm or less that can cause a shearing force) such that at least one buffering space retains the mixture. The disperser explained above is also characterized by the outer circumferential wall that defines the buffering space being provided on the rotor.

Next, a feature for adjusting the width of the gap will be explained with reference to FIGS. 11 to 15, as a feature that is preferably used in combination with the shearing disperser that is characterized by the buffering space explained with reference to FIGS. 1 to 10, etc.

Namely, the circulation-type dispersing system 200 or the dispersers 1, 31, 71, 81, 91, 131, 191 in the system may have a driving mechanism for driving either the rotor or the opposing member or both to allow one of them to move toward and away from the other of them. The driving mechanism may be installed in the circulation-type dispersing system to prevent a mechanical component or a pipe from being damaged by increased internal pressure in the pipe if the mixture jams between a pair of rotors or between the rotor and the stator in the disperser. The detailed configuration of the driving mechanism and the function and effect of it will be explained in detail in the discussion on the circulation-type dispersing system 400 of FIG. 11.

Figure 11:
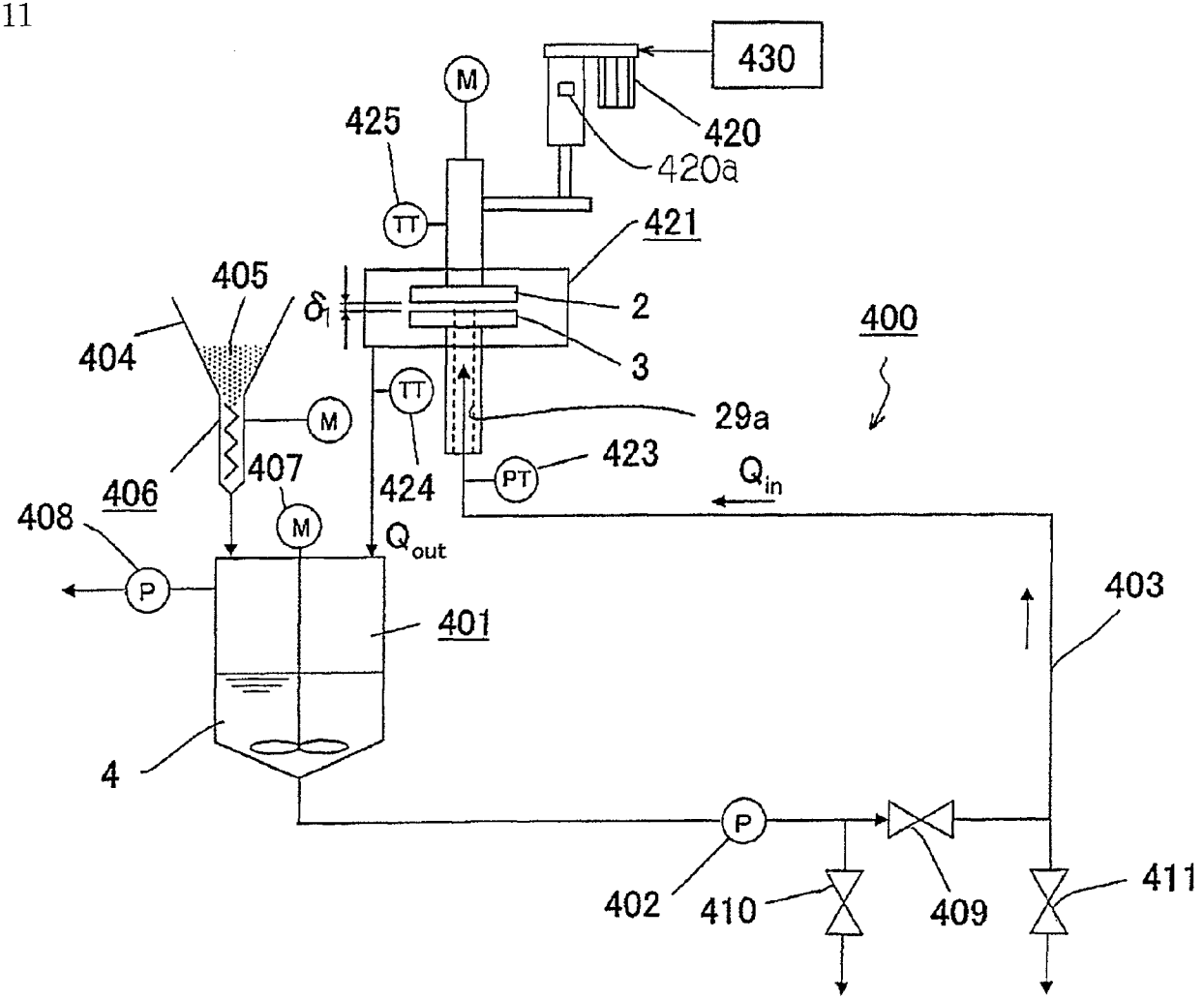
FIG. 11 illustrates another example of the circulation-type dispersing system of the present invention. It shows a schematic view of the configuration in the example where the system comprises a disperser equipped with a mechanism for adjusting the gap between the rotor and the opposing member.

Next, the circulation-type dispersing system 400 of the present invention is explained with reference to FIGS. 11 and 12. The circulation-type dispersing system 400 in FIG. 11 comprises a rotor-type continuous-type disperser for dispersing a mixture (the disperser is any of the dispersers 1, 31, 71, 81, 91, 131, and 191, as explained with reference to FIGS. 1 to 7, etc. (a disperser in which a stator is replaced by another rotor is also included), wherein the disperser further has a mechanism for adjusting the gap (the driving mechanism 420). Below the system is explained by assuming that the disperser 421 has the same configuration as the above disperser 1, except for having the driving mechanism 420. The figure, in which M represents a motor, illustrates an example where the disperser is disposed vertically. However, as discussed above, the system is not limited to this. The circulation-type dispersing system 400 comprises the following: a tank 401 that is connected to an outlet side of the disperser 421, etc.; a circulating pump 402 that is connected to an outlet side of the tank 401 and circulates the mixture 4; and a pipe 403 for serially connecting the disperser 421, etc., the tank 401, and the circulating pump 402. $Q_{in}$ in FIG. 11 shows the flow of the mixture. $Q_{out}$ shows the flow of the mixture being discharged toward the tank 401 after the dispersion.

Figure 12:
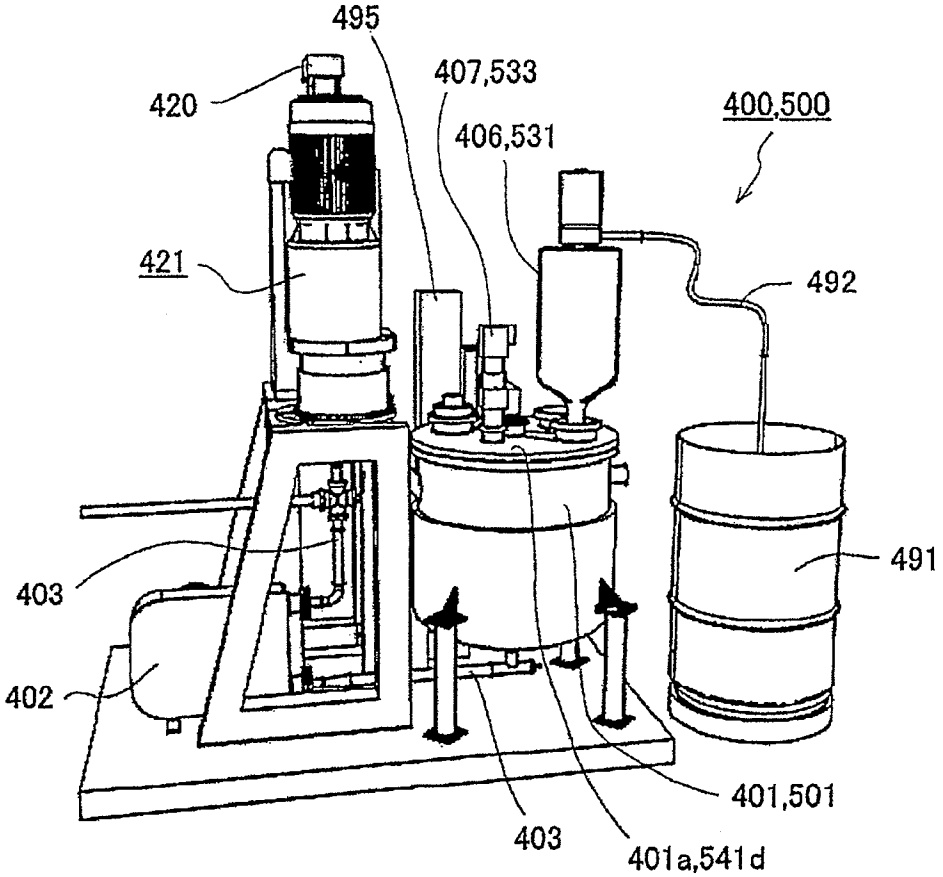
FIG. 12 is a perspective view in a more detailed example of the configuration of the circulation-type dispersing system of FIG. 11, etc.
Figure 16:
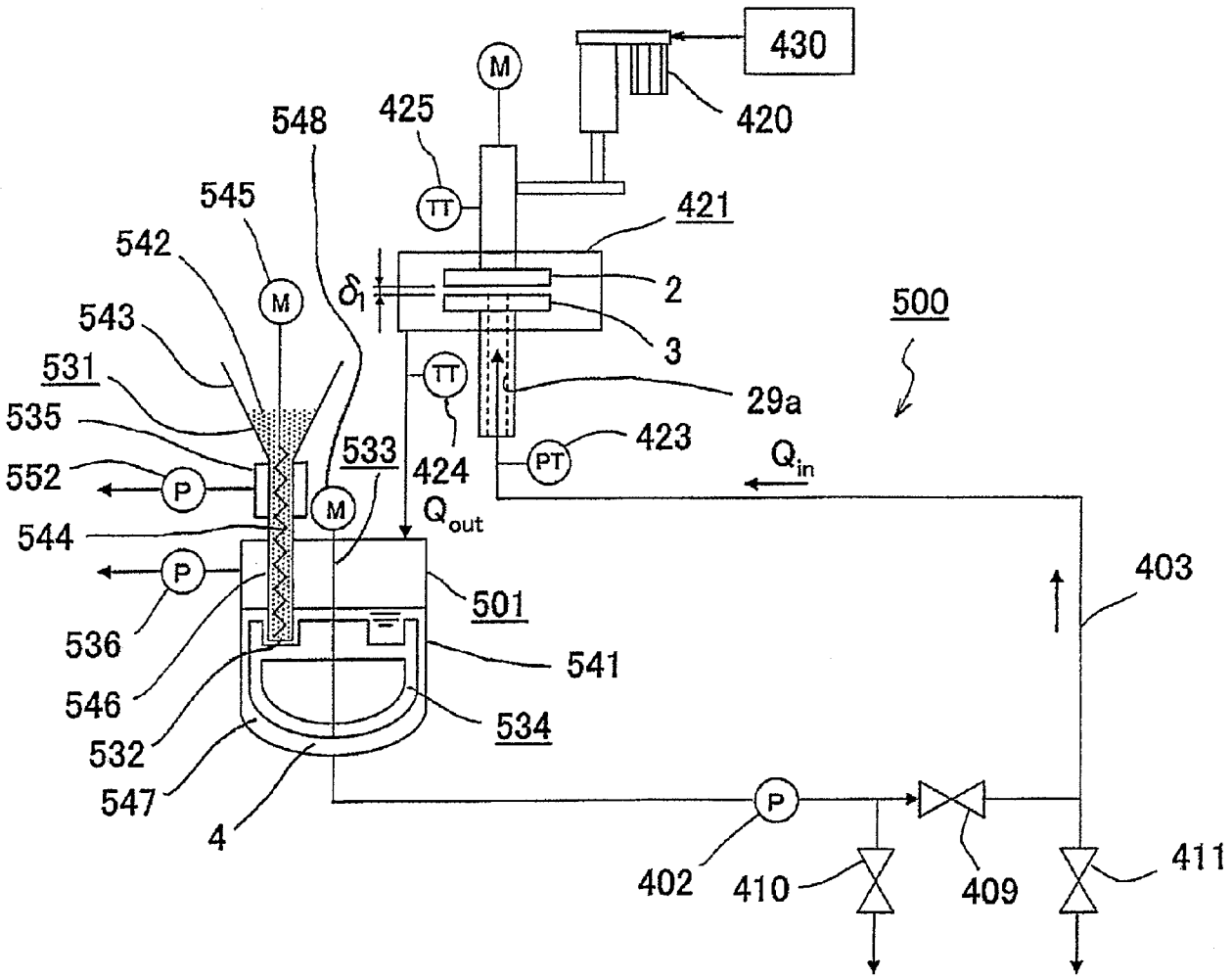
FIG. 16 illustrates yet another example of the circulation-type dispersing system of the present invention. It shows a schematic figure of the configuration of an example where the system comprises a tank having a characteristic screw-type powder feeder.

Incidentally, FIG. 12 illustrates an example of a configuration of each component of the circulation-type dispersing system 400 in FIG. 11 or the following circulation-type dispersing system 500 in FIG. 16. However, the circulation-type dispersing systems of the present invention are not limited to this configuration. As in FIG. 12, a tank 491 for storing a powder additive is connected to the circulation-type dispersing system 400 through an additive-supplying pipe 492. The tank 491 supplies a powder additive into the feeder 406 through the additive-supplying pipe 492 by suction power. The system 400 in FIG. 12 has an elevating apparatus 495 for lifting and lowering a top cover 401*a* of the tank 401 during maintenance.

Incidentally, the fluid that circulates inside the tank 401, the disperser, and the pipe 403 is initially a raw material. The added raw material is gradually dispersed every time the mixture passes through the disperser, and then it finally becomes a dispersed mixture. In the above and the following explanation, the initial "raw material," and the "mixture" being processed, are both referred to as a "mixture."

The system 400 comprises the following: a driving mechanism 420 for driving either the rotor 2 or the stator (opposing member) 3 of the disperser 421 or both to allow one of them to move toward and away from the other of them (in the following description, for example, the rotor 2 will be driven); and a controlling member 430 for controlling the driving mechanism 420. The driving mechanism 420 is a servocylinder, for example. The driving mechanism 420 can broaden or narrow the gap D1 between the rotor 2 and the stator 3 by upwardly and downwardly moving a unit containing the rotating shaft of the rotor 2 and the motor M for rotating the shaft. In the following description, for example, an electric servocylinder which is equipped with a load cell (load converter 420*a*), etc., will be used as the driving mechanism 420.

The system 400, which is equipped with the driving mechanism 420, can clear the jam by broadening the gap D1 to prevent a mechanical component or a pipe (especially, a joint) from being damaged by increased internal pressure in the pipe, when the mixture jams or can jam between the rotor 2 and the stator 3.

The controlling member 430 adjusts the gap between the rotor 2 and the stator 3 based both on a pressure detected by a pressure sensor 423 for detecting pressure caused by a mixture between the rotor and the opposing member and on a temperature detected by a temperature sensor 424 for measuring a temperature of a mixture discharged from a position between the rotor and the opposing member. Incidentally, the controlling member 430 may adjust the gap based on either a pressure detected by the sensor 423 or a temperature detected by the sensor 424.

The pressure sensor 423 is disposed at a position where its internal pressure is highest in the pipe 403. For example, the sensor is disposed in front of a position where the mixture is input into the disperser 421 as in FIG. 11. Incidentally, when a servocylinder is used as the driving mechanism 420, the load cell (load converter 420*a*) installed at the tip of the servocylinder may be used as a pressure sensor. Or the load cell may be used in combination with the pressure sensor 423. The pressure sensor built in the servocylinder may also be used.

To detect a temperature of the mixture discharged from the disperser 421, as in FIG. 11, the temperature sensor 424 is attached to the pipe 403 just after the outlet side of the disperser 421. Further, a temperature sensor 425 for detecting the temperature of the bearing of the rotor 2 is installed in the system 400. The relationship between the temperature detected by the temperature sensor 425 and the width of the gap D1, which width varies due to the thermal expansion or the thermal contraction of each mechanical component when the temperature changes, may in advance be measured and memorized in a memory in the controlling member 430. Thereby the controlling member 430 can adjust the gap D1 by driving the driving mechanism 420 based on the temperature detected by the temperature sensor 425 to move the rotor 2 along the shaft. Thereby the controlling member 430 can prevent the internal pressure from increasing or decreasing.

Hereafter, the system will be explained more specifically. As in FIG. 11, the outlet of the tank 401, which serves as a tank for storing a mixture, is connected to the circulating pump 402. The circulating pump 402 transports and circulates the mixture. The feeder 406 installed above the tank 401 infuses an additive 405 (a liquid or particulate material) that is stored in the hopper 404 into the circulating mixture (the mixture is initially a raw material). The mixture into which an additive has been infused is supplied into the rotor-type continuous-type disperser 421 installed at a vertical (perpendicular) position above the tank 401.

The disperser 421 has a rotor 2 and a stator 3 that are vertically disposed to oppose each other. In the disperser 421, the axis is installed vertically, the rotor 2 is installed in an upper position, and the stator 3 is installed in a lower position. Incidentally, they may be replaced by a pair of rotors that rotate in opposite directions. Incidentally, the axis may be disposed horizontally such that the rotor and the stator are disposed horizontally to oppose each other. The rotor 2 and the stator 3 uniformly disperse the additive in the raw material. The mixture dispersed between the rotor 2 and the stator 3 in the disperser 421 is brought back into the tank 401 by gravity without being attached to the rotor cover of the disperser 421. The agitator 407 prevents the mixture in the tank 401 from not becoming homogeneous, etc., by agitating it.

A screw feeder, a rotary valve, a plunger pump, etc., can be suitably used as the feeder 406 for the additive 405. The position to install the feeder 406 may be a position along the pipe 403 for the circulation, or may be selected from any position along the pipe 403.

The vacuum pump 408 is connected to the tank 401. When the discharge from the disperser 421 is not sufficient, the vacuum pump 408 can decompress the inside of the tank to assist the discharge. Further, the decompression by means of the vacuum pump 408 serves also as a defoaming function when foam is mixed with the mixture.

In the system 400, during the process a bulb 409 is always open and a bulb 410 is always closed. The bulb 409 is closed and the bulb 410 is opened when the dispersion is finished. Thereby processed materials can be discharged and collected from the bulb 410. The mixture which remains in the disperser 421 or the pipe 403 is discharged and collected by opening the bulb 411. Incidentally, a bulb for discharging and collecting the mixture may be attached to any position in the tank or the pipe.

The system 400 has the disperser 421, which has the same configuration, function, and effect as those of the disperser 1, etc., as in FIGS. 1 to 7. Thereby the system 400 can carry out an efficient and appropriate dispersion. Thus the entire system also shortens the time for the dispersion while the performance in the dispersion is improved at the same time.

The system 400 is one that carries out a batch process as an entire system (hereafter, the system will be referred to as a "batch circulating system"). So, the system can uniformly disperse a material, because the system can discharge the material after uniformly dispersing it. Further, the batch circulating system can ensure a raw material can be traced. Namely, even if an inspection detects that that an obtained product has undesired properties (when the grain sizes of the product are varied or when there are too many impurities in the product, etc.,), the raw material (a liquid material) and the additive (a powder material) that caused the undesired properties can be readily specified. In other words, the raw material and the additive from which a defective product was obtained can be traced. This is an advantage in the batch method. In contrast, for example, it is difficult to trace a raw material in a so-called continuous-type dispersing system, which allows a material to pass through a disperser and a tank only once. Further, using the batch circulating system provides an advantage in that the time for carrying out a defoaming process can be shortened, because, for example, the vacuum pump 408, etc., can carry out a vacuum defoaming process. Further, using the batch circulating system makes it easy to combine the tank disposed in a former process to store a powder additive and the tank disposed in a latter process to store a dispersed product. Namely, the tank 491 for storing a powder additive may be added to the dispersing system 400. Further, in the dispersing system 400, the tank 491 may be disposed near a tank for a dispersed product, because the configuration of the system is simple. Accordingly, the system 400 achieves the above innovative production of slurry (dispersion) while the system 400 is a batch circulating system at the same time. So, the system achieves a continuous operation while ensuring a high dispersing effect and traceability. In addition, the system is a compact one that has a high performance and a high reliability. Accordingly, the system can meet the users' demands for making the system simpler, and smaller, and for dealing with a complicated manufacturing process. The above and the following circulation-type dispersing systems 200, 500 also have the same advantages explained in this paragraph.

Figure 13:
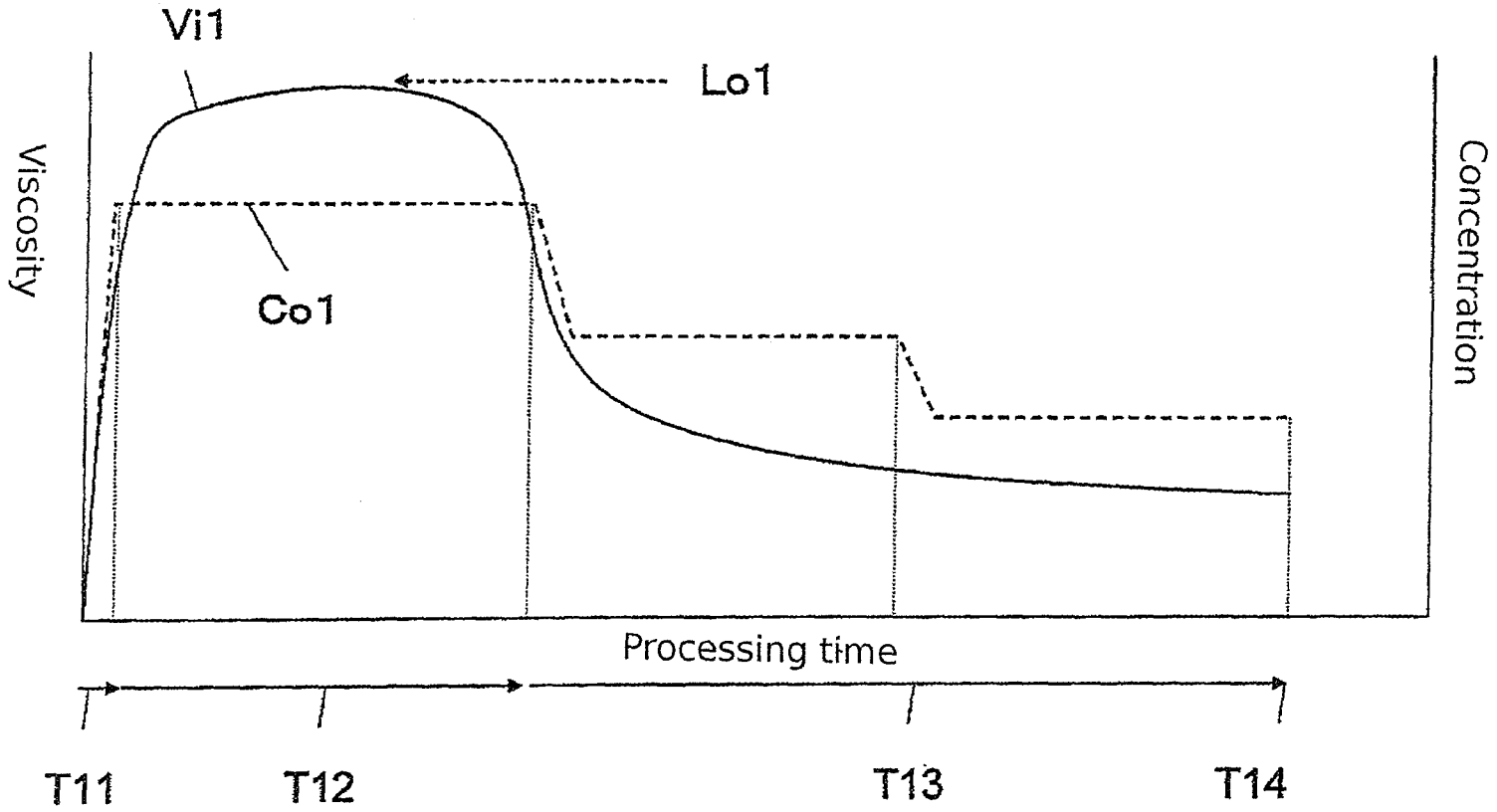
FIG. 13 illustrates the advantages in the method of thinly kneading and then concentrating a mixture carried out by means of the circulation-type dispersing system of FIG. 11, etc., in comparison to the advantages of the method of gradually diluting a mixture.
Figure 14:
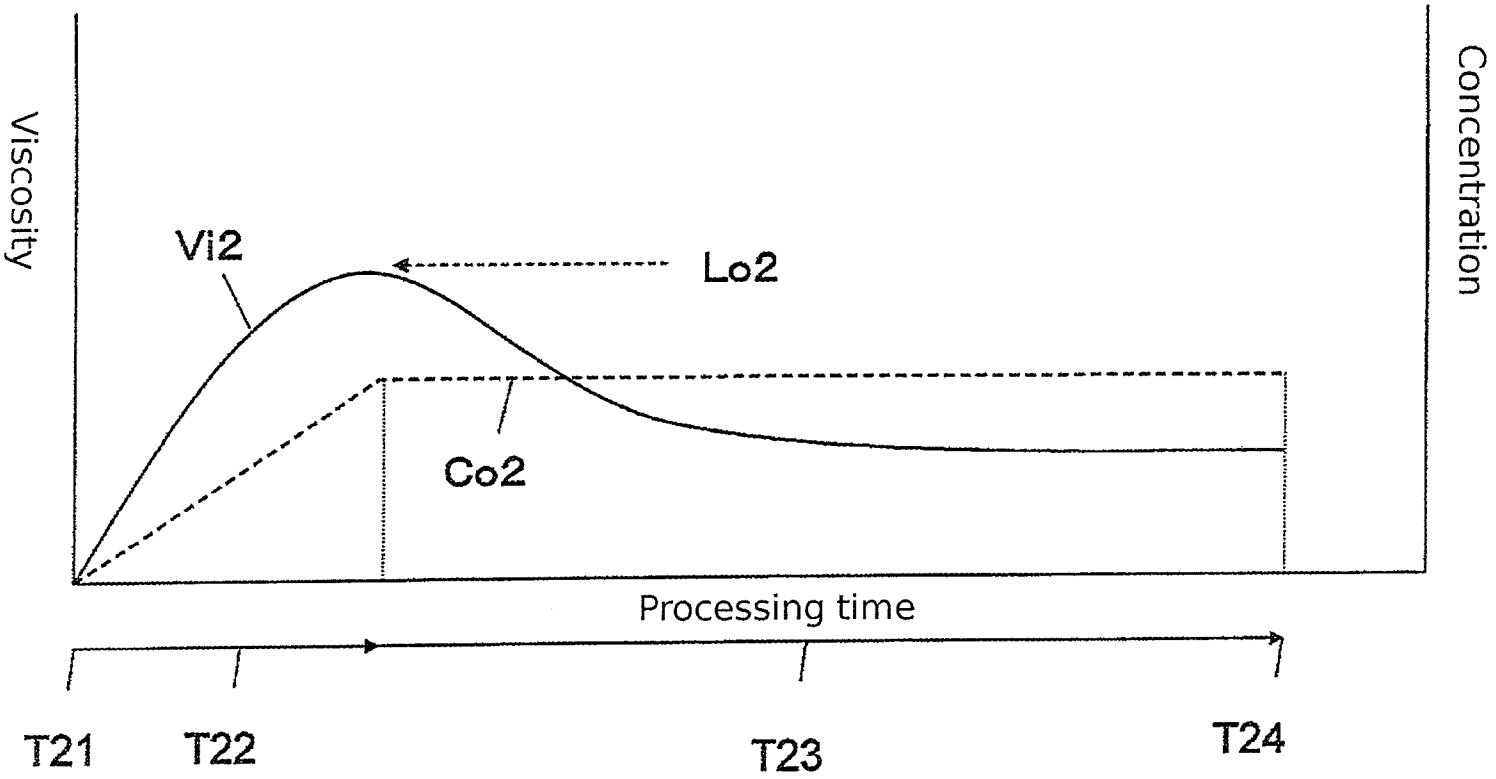
FIG. 14 illustrates the viscosity and the concentration in relation to the processing time in the method of thinly kneading and then concentrating a mixture.

The system 400 is further characterized in that it disperses a raw material to be treated and an additive by means of the above shearing disperser while circulating the raw material and gradually adding the additive therein. Namely, the system 400 is further characterized in that it uses a "thickening method," which starts from an initial state where a raw material has a low viscosity (a state where a powder additive is added at a low rate) and then gradually concentrates the powder additive while kneading it. For example, the advantage of the "thickening method" will explained in comparison to the "thinning method," which is a method to be compared with the former method. In the thinning method, first an initial state where the viscosity is very high (a state where a powder additive is added at a high rate) is made by adding all of the powder additive in a tank, and then the mixture is strongly kneaded at a comparatively slow speed of shearing. Then the mixture is gradually diluted while being dispersed in the entire mixture. The viscosity and the concentration in relation to the processing time in the thinning method is shown in FIG. 13. Also, those in the thickening method are shown in FIG. 14. In FIGS. 13 and 14, the horizontal axes show the processing time, the vertical axes show the viscosity and the concentration, Vi1 and Vi2 show the change of the viscosity, and Co1 and Co2 show the change of the concentration. T11 shows the period for injecting an additive and a solvent, T12 shows the period for kneading at a high viscosity, T13 shows the period for diluting and mixing a mixture, and T14 shows the termination of the process. Also, T21 shows the time for injecting a solvent, T22 shows the period for injecting a powder and for dispersing and mixing it, T23 shows the period for kneading it and for dispersing and mixing it, and T24 shows the time of the termination of the process. Also, Lo1 and Lo2 show the load to determine a motor capacity. Namely, a motor capacity must be determined in view of a maximum viscosity. Accordingly, the greatest dispersing effect can be achieved by using the "thickening method," such as the circulation-type dispersing system, even when the motor for the rotor of the disperser 421, etc., has a small capacity. The configuration of the entire device can be made smaller because the motor capacity can be made small. Further, the process in FIG. 14 was efficient because the dispersion effectively utilized the capability of the motor. This is because the change of the viscosity in FIG. 14 was smaller than that in FIG. 13.

Further, the system 400 exerts a characteristic effect due to having the driving mechanism 420, etc. Before explaining the characteristic effect due to having the driving mechanism 420, etc., a problem that can be caused in the system 400 when it does not have the driving mechanism 420 will be explained. Namely, a mechanical component or a pipe may be damaged by abnormally increased internal pressure in a pipe in a system that does not have a driving mechanism. The most probable cause of the abnormally increased internal pressure in a pipe is a blockage by a solid obstruction in a position that has the highest flow resistance, namely, a gap between a rotor and a stator (this corresponds to the gap D1 in FIG. 11), or between a pair of rotors. To prevent this and protect a device and a system, for example, an upper limit of pressure may be set in advance, and a pressure sensor may be installed to detect a pressure at a position where an internal pressure is highest, to stop the operation when a detected pressure exceeds the upper limit. However, such a configuration to stop the operation causes a loss of time until the operation restarts. So, it is preferable to prevent the internal pressure from increasing before the upper limit of the pressure is reached. Namely, it is preferable to remove an obstruction in a gap between a rotor and a stator, or a gap between a pair of rotors, before the upper limit of the pressure is reached.

The first method to remove a blockage caused by a solid obstruction in a gap between a rotor and a stator or between a pair of gaps is to widen the gap. The second method is to increase the frequency of the rotation of a rotor. The third method is to reduce a flow rate of a pump. Namely, for example, the first method is a method for widening the gap to make a blockage caused by a solid obstruction flow out when pressure above a predetermined threshold value is detected. The second method is a method in which the frequency of the rotation of a rotor is increased to enhance a shearing force such that the solid obstruction in the gap is destroyed. The third method is a method in which a flow rate of a pump is slowed to reduce the internal pressure in a pipe to gain sufficient time until the solid obstruction is destroyed by the shearing force caused by the unchanged rate of rotation of the rotor. The first method is used in the system 400, because it is the most direct solution among them to remove an obstruction, and it is the best one. Incidentally, the second and the third methods are essential in terms of destroying a blockage caused by a solid obstruction. However, they cannot always immediately destroy a blockage caused by a solid obstruction to remove it if it has a high breaking strength. In the above and the following description, the functions and the effects of the first method will be explained. However, the second and the third methods can be used instead of or in combination with the first method. Namely, an efficient method is to increase the frequency of the rotation or to decrease the flow rate as needed, such that the gap, the frequency of the rotation, and the flow rate are gradually set back to the original settings (usual operating values) during the circulating operation after an increased pressure is canceled by widening the gap to make the blockage caused by a solid obstruction flow out. Such a control can be carried out by means of the controlling member 430.

As discussed above, to adjust the gap D1 between the rotor 2 and the stator 3, the driving mechanism 420, such as a servocylinder, is installed in the system 400 and in the disperser 421, which is a component of the system. Also, the system 400 can disperse a slurry mixture having a high concentration and a high viscosity. The rotor 2 is formed by connecting the motor M to an upper disk-like member. The gap D1 between the stators 3 and the rotor 2 is adjusted by moving up and down an upper unit, which includes the rotor 2, by means of the driving mechanism 420 (a servocylinder). A lower disk-like member, which serves as the stator 3, has a structure in which no shaft-sealing part is formed, so as to provide the member with an improved durability against a slurry. (The member does not have a rotating component. So it does not require a shaft-sealing part.) A slurry mixture that is being dispersed is supplied through the central axis of the stator 3 into the dispersing area (between the rotor 2 and the stators 3). Incidentally, the detection of the pressure was carried out by means of the pressure sensor 423, which is installed at a position where the internal pressure is highest in the pipe. However, the detection of the pressure can be carried out by means of a load cell (for example, a load converter 420*a* in FIG. 11) built in the driving mechanism 420 (servocylinder) or installed at the tip of the cylinder. Further, the controlling member 430 can control the frequency of the rotation of the rotor and the flow rate of the pump via the inverters that are connected to driving motors.

An efficient dispersion can be achieved by beforehand preparing software for controlling the gap D1, etc., between the rotor 2 and the stator 3, the frequency of the rotation of the rotor, and the flow rate, if the properties of a mixture in the dispersion can be predicted, such as in the system 400. For example, in a process for producing a slurry mixture by circulating a liquid raw material to be treated while gradually adding a powder additive to the raw material, solids can easily aggregate and jam in the gap between the rotor and the stator, etc., in an early stage of the operation. In such a case, in an early stage of the operation, in advance, the gap is widened, and the frequency of the rotation of the rotor is increased. Then a desired dispersion in which the gap and the frequency of the rotation of the rotor are set back to the original settings (the usual operating values) can be carried out, after a powder additive is supplied. Then aggregated solids are destroyed while a slurry mixture consisting of a liquid raw material to be treated and a powder additive circulates. Then the slurry is stabilized such that it cannot jam. In this case, reducing a flow rate means that the frequency in which the liquid passes through the shearing (dispersing) area is decreased and the processing time will be longer. So, the method for reducing a flow rate may not be used.

If a plurality of powder additives are supplied one after another in a process for producing a slurry in the system 400, an efficient and appropriate dispersion can be achieved by beforehand preparing the controlling software, even when the optimal gap between the rotor and a stator, the frequency of the rotation of the rotor, and the flow rate in respective stages, differ.

A process for discharging a mixture (product), after the dispersion in the system 400 is finished, can also be made efficient by controlling it. After the dispersion, the discharging process is serially carried out without stopping the dispersion. The discharging process is carried out by closing the bulb 409 and opening the bulbs 410, 411 to discharge and collect a mixture (product) from the bulbs 410, 411. In this period, the operation of the disperser 421 is stopped, namely, the rotation of the rotor 2 is stopped to prevent an excessive dispersion. So, it is hard to discharge the mixture (product) between the rotor 2 and the stator 3, because the flow resistance in the gap is great. In such a case, the flow resistance can be lowered by widening the gap to increase the discharging speed. If the mixture has a high viscosity, or if a buffering space is provided between the rotor and the stator in the disperser (as discussed above with reference to FIGS. 1 to 7), this is very effective, because in those cases the amount of the mixture which should be discharged is large.

The opposing parts, each of which is a disk-like member, of the rotor 2 and the stator 3, generate heat by friction, because a disk-type disperser, such as the disperser 421 disclosed above, etc., causes great shearing stress by a high-speed rotation in order to carry out a dispersion. The gap between the rotor 2 and the stator 3 can be reduced because of the thermal expansion of the opposing parts, the shafts, or other associated components.

If the gap between the rotor 2 and the stator 3 is reduced, the flow resistance will increase and it will be a cause of unusual pressure. So, the safety of the system can be improved by measuring the temperature of a raw material in addition to detecting the pressure and using the measured temperature to predict, and prevent, an increase of pressure. Because the position where the temperature of a raw material is highest is the gap between the rotor 2 and the stator 3, and because the rotor rotates at a high speed, detecting a temperature at that position is difficult. However, an almost equivalent temperature can be measured by disposing the temperature sensor 424 on a pipe just after that position. A temperature sensor can be comparatively easily attached to the stator 3.

Further, if needed, the temperature sensor 425 can be configured such that it can measure the temperature of the bearing. An increased pressure can be prevented by controlling the gap so as to have an appropriate width such that the reduced gap is compensated for by a device, such as a servocylinder (the driving mechanism 420), in view of an increased temperature, based on a previously obtained relationship between temperature and the gap between the rotor 2 and the stator 3. Incidentally, as a result, such a control can further prevent the temperature from increasing, though the purpose of such a control is to prevent the pressure from increasing.

Further, the operating control, by measuring the temperature, can also be used for the two following purposes. The first purpose is to deal with the fact that a reduced gap because of thermal expansion can cause an overload and an abnormal sound (noise) caused by the contact of the rotor 2 with the stator 3 (this would be the same even if a pair of rotors were to be used) and can be a cause to break the opposing part (disc-like member). Namely, the first purpose is to prevent the thermal expansion and the abnormal sound and to appropriately control the gap. The second purpose is to aggressively control the temperature to prevent a raw material from becoming denatured because of an increased temperature, etc., Namely, when a temperature above a predetermined value is detected in a mixture, then regardless of the pressure, the gap between the rotor 2 and the stator 3 is widened and the frequency of the rotation of the rotor 2 is reduced such that the frictional heat generated in the mixture can be suppressed.

As discussed above, the system 400, which comprises the driving mechanism 420, can prevent a mixture from jamming in the gap D1 between the rotor 2 and the stator 3 in the disperser 421. The system can further prevent a mechanical component or a pipe from being impaired by an increased internal pressure in the pipe. So, the system can carry out an efficient and appropriate dispersion. Incidentally, the driving mechanism 420 can be used not only in a disperser comprising a rotor and a stator, but also in a disperser comprising a pair of rotors. Further, the mechanism can prevent a mixture from jamming in the gap between a pair of rotors. Accordingly, the mechanism can prevent a mechanical component or a pipe from being impaired by an increased internal pressure in the pipe.

Also, the system 400 can beforehand detect a state in which a blockage of a mixture can occur and prevent it from occurring. So, the system can surely prevent a mechanical component or a pipe, etc., from being impaired. This is because the controlling member 430 adjusts the gap (gap D1) between the rotor 2 and the stator 3, based on either a pressure detected by the pressure sensor 423 or a temperature detected by the temperature sensor 424, or on both the pressure and the temperature.

In the system 400, a low rotational speed is used while the viscosity is high, and then the speed is gradually increased by the controlling member 430. Also, the gap should initially be wider, because the load on the system will be too heavy if the gap (the space between the opposing surfaces) is too narrow while the viscosity is high. Then the gap is narrowed to enhance the shearing force when the viscosity decreases. Thereby, for example, an appropriate dispersion is achieved by operating the system such that the viscosity and the concentration in relation to the processing time will have the relationship as in FIG. 14.

Further, the system 400 achieves a quick dispersion due to the high shearing effect caused by the high-speed rotation of the rotor in the disperser 421. The shearing force of the disperser 421 can be denoted by "$\tau$" in the following formula: $\tau=\mu*(dv/dx)$, where "$\mu$" is the viscosity, "dv" is the velocity, and "dx" is the gap between the rotor and the opposing member (the interval between the opposing surfaces). The disperser 421 can exert a high shearing effect by controlling the driving mechanism 420 such that the value of dx gives the desired shearing force, and thus the disperser achieves a quick dispersion. Further, the controlling member 430 can control the gap between the rotor and the opposing member, the amount circulated by the circulating pump 402, and the frequency of the rotation of the rotor 2. Thereby a flexible dispersion can be carried out in an optimized condition. For example, the gap, the circulating amount, and the frequency of the rotation, are appropriately controlled such that the viscosity and the concentration in relation to the processing time will have a relationship as in FIG. 14. Thereby a dispersion in which the maximum function of a motor is achieved, is obtained. Namely, the device can be made smaller, and the processing time can be shortened.

Further, the system 400 achieves improved efficiency in cleaning and maintenance because of its structure and its specifications. The system 400 can remove any remaining materials by circulating a cleaning liquid after a dispersion is finished. Further, the system 400 has a structure that can be easily disassembled. For example, the disperser 421 can be disassembled into the rotor 2 and the stator 3 by means of the driving mechanism 420. Further, the pipe 403 can be readily attached and detached, because it is configured to be connected by a quick coupling device, such as a ferrule. Further, the top cover 401*a* of the tank 401 can be readily raised by means of the elevating apparatus 495, because the top cover is configured such that it can be raised and lowered by means of the elevating apparatus 495 if a coupling member, such as a bolt, is removed. As discussed above, the system 400 achieves improved efficiency in cleaning and maintaining.

The disperser 421, which has the driving mechanism 420, can prevent a mixture from jamming in the gap D1 between the rotor 2 and the stator 3 and thus prevent a mechanical component or a pipe from being impaired by an increased internal pressure in the pipe. The above driving mechanism 420 was explained as a component added to the disperser 1. However. it can be used also in the dispersers 31, 71, 81, 91, 131, 191 as discussed with reference to FIGS. 2 to 7. The above driving mechanism 420 exerts the same effects as those in the above disperser 421 (hereafter, those dispersers involving the driving mechanism 420 will be referred to as "disperser 421, etc.").

Further, the disperser 421, etc., which has the driving mechanism 420, and the system 400, etc., in which the disperser 421 is used, have the following advantages. Namely, the disperser 421, which has the driving mechanism 420, can be an apparatus for carrying out a two-step dispersion consisting of a first mixing step and a second mixing step. Incidentally, the first mixing step is to mix a raw material to be treated with a first additive. The second mixing step is to mix a first mixture obtained by completing the first mixing step with a second additive. In the disperser 421, etc., the driving mechanism 420 is characterized in that it changes the gap between the rotor 2 and the stator 3 after the first mixing step is completed and before the second mixing step is started.

By the way, the disperser 421, etc., can be used to obtain, for example, a raw material for an electric cell, a raw material for painting, an inorganic chemical product, etc. The raw material for an electric cell is, for example, water (distilled water or ion-exchanged water) or NMP (1-methyl-2-pyrrolidone). The first additive is, for example, a thickening material such as carboxymethyl cellulose (hereafter, "CMC") powder and polyvinyl alcohol (hereafter "PVA") powder. The second additive is a positive-electrode active material for lithium-ion batteries (a $LiCoO_2$-based compound, a $LiNiO_2$-based compound, a $LiMn_2O_4$-based compound, a Co—Ni—Mn-based complex compound, $LiFePO_4$/$LiCoPO_4$, etc.), a carbon-based material that is a negative-electrode active material for lithium-ion batteries, a positive/negative-electrode active material for lithium-ion capacitors, or a conductive aid (black lead, cork, carbon black, acetylene black, graphite, Ketchen black, etc.), a negative-electrode active material for lithium-ion batteries (an Sb-based compound [SbSn, InSb, $CoSb_3$, $Ni_2MnSb$], a Sn-based compound [$Sn_2Co$, $V_2Sn_3$, $Sn/Cu_6Sn_5$, $Sn/Ag_3Sn$], a Si-based complex material, etc.), a positive-electrode active material for nickel hydroride batteries ($Ni(OH)_2$), a negative-electrode active material for nickel hydroride batteries, i.e., a hydrogen-storing alloy (TiFe, $ZrMn_2$, $ZrV_2$, $ZrNi_2$, $CaNi_5$, $LaNi_5$, $MmNi_5$, $Mg_2Ni$, $Mg_2Cu$, etc.), a binder (a fluorine resin [PTFE[polytetrafluoroethylene], PVDF[polyvinylidene fluoride]], fluororubber [based on vinylidene fluoride], SBR [styrene butadiene rubber], NBR [nitrile rubber], BR [butadiene rubber], polyacrylonitrile, an ethylene-vinyl alcohol copolymer, ethylene propylene rubber, polyurethane, poly-acrylic acid, polyamide, polyacrylate, polyvinyl ether, polyimide, etc.). In addition to them, various inks, coating materials, pigments, ceramic powder, metal powder, magnetic powder, drugs, cosmetics, foodstuffs, agricultural chemicals, plastic (resin) powder, wood powder, natural or synthetic rubber, adhesives, thermosetting/thermoplastic resins, etc., are listed as the raw material.

Further, the gap can be set at a broader value when the first mixing step is started, and then the gap can be gradually narrowed as the mixture is dispersed. Also, the gap can be narrowed after the first mixing step is completed and before the second mixing step is started.

The disperser 421, which has the driving mechanism 420 as discussed above, enables the system 400 alone to carry out the first step and the second mixing step. Further, the disperser 421 can simplify the mechanical components and shorten the total processing time. Next, these effects will be explained in a specific example.

Below, the effects caused by carrying out the first and second mixing steps by means of the disperser 421, which has the driving mechanism 420, will be explained in an example in which the system 400, which has the disperser 421, is used for producing a paste for lithium-ion batteries. In this example, in which the disperser 421 and the system 400 are used, CMC powder, which is the first additive, is mixed into water, which is a raw material to be treated, to obtain a first mixture. Then an active material, which is the second additive, is mixed with the first mixture to obtain a dispersed second mixture (a finished product). In the first mixing step, the gap between the rotor and the stator in the disperser 400 is set at a broader value to prevent an obstruction from occurring. Then in the second mixing, the gap is made narrower, to exert a desired shearing force for the dispersion.

Namely, in the system 400, first, CMC powder is gradually loaded into the circulating water to obtain a CMC aqueous solution. CMC aqueous solutions can easily cause a pellet (this is referred to also as an "unmixed-in lump of powder"). So, the gap between the rotor 2 and the stator 3 (the interval between the opposing surfaces) in the disperser 421 is first set at a broader value to prevent a blockage and an increased pressure caused by it. Then the gap is gradually made narrower while a dispersion is carried out to enhance a shearing force such that the CMC is uniformly dispersed throughout the water. The "unmixed-in lump of powder" is a solidified object that remains as a powder without being dispersed in liquid. In other words, the term means that a mixture consists of liquid and powder and contains a part having a high viscosity. Next, in the system 400, the controlling member 430 adjusts the gap of the disperser 421 such that the gap is automatically narrowed to have a predetermined width (about 2 mm or less). Then the active material (powder) is loaded without the operation being stopped. Then the active material is dispersed in the CMC aqueous solution to obtain a slurry product, which is the second mixture.

As discussed above, the system 400 and the disperser 421, which carry out the two mixing steps, can eliminate the need for another device for preparing a CMC aqueous solution. Thereby they can eliminate transporting and loading a CMC aqueous solution. Further, they can save the time and effort for the cleaning and the maintenance of the device used to prepare a CMC aqueous solution. So, though more time for gradually loading CMC to obtain a CMC aqueous solution is required, the system 400 and the disperser 421 can shorten the total processing time and thus can carry out an efficient and appropriate dispersion, because the dispersion is continuously carried out while the gap is automatically adjusted without the operation being stopped. In other words, a CMC aqueous solution must be separately prepared if a disperser that does not have the driving mechanism 420 is used, and then an active material must be added and dispersed in the CMC aqueous solution which was prepared as a raw material to be treated. In contrast, if the disperser 421, etc., is used, two mixing steps can be carried out by adjusting the gap. Namely, the disperser can exert the above effects by carrying out a batch process.

Figure 15:
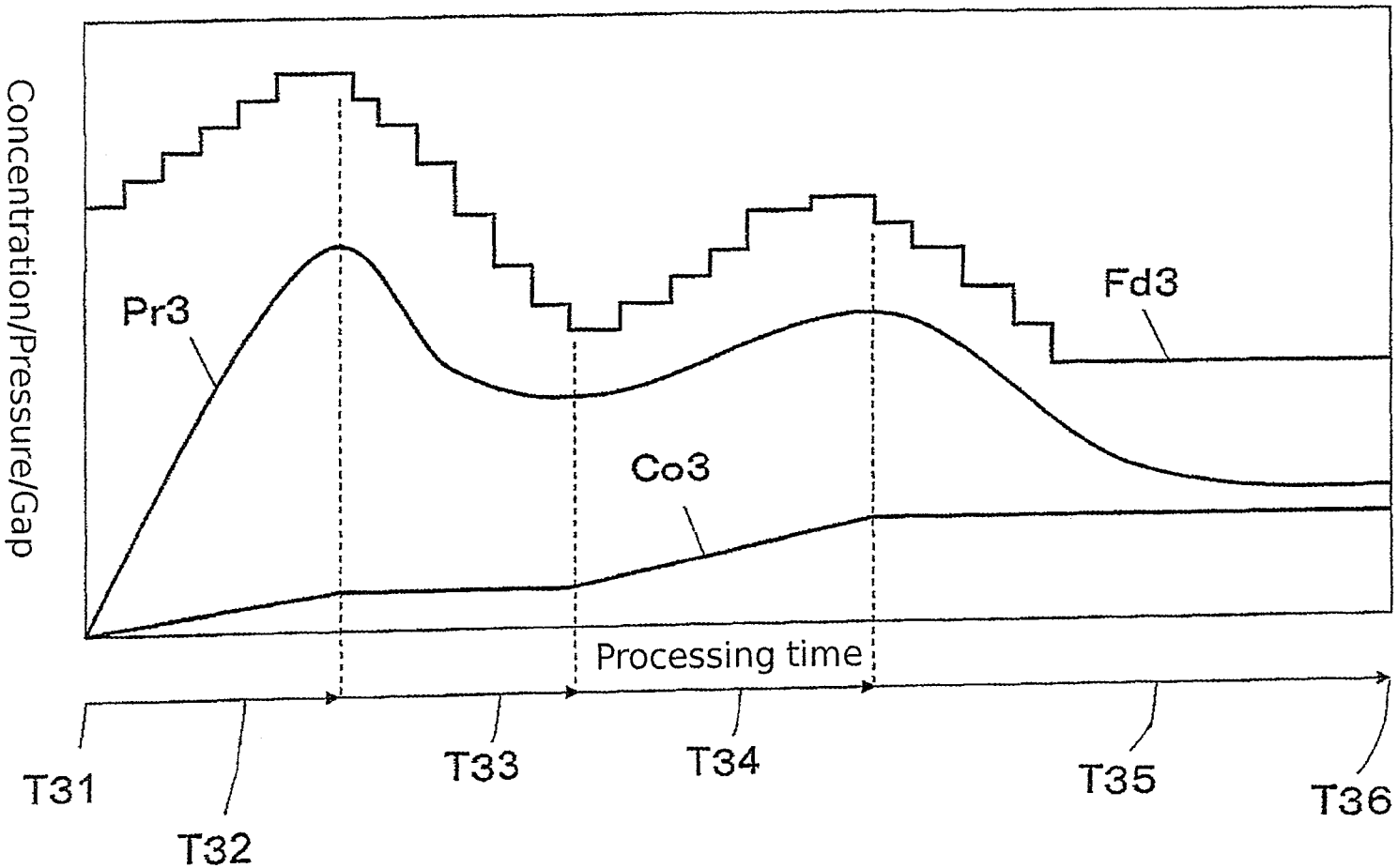
FIG. 15 illustrates the relationship between the concentration, the pressure, the gap, and the processing time when a two-step mixing process is continuously carried out by means of the circulation-type dispersing system of FIG. 11.

Below, an example of changes in the concentration, the pressure (the pressure is detected by the pressure sensor 423), and the gap (the gap between the rotor and the stator) as the processing time goes by when the two mixing steps are continuously carried out will be explained with reference to FIG. 15. In FIG. 15, the horizontal axis shows the processing time. The vertical axis shows the concentration, the pressure, and the gap. Co3 shows the change of the concentration. Pr3 shows the change of the pressure. Fd3 shows the change of the gap. T31 shows the time for loading a solvent. T32 shows the period for adding the first additive (powder). T33 shows the period for the dispersion and the mixing. T34 shows the period for adding the second additive (powder). T35 shows the period for the dispersion and the mixing. T36 shows the time of the termination.

If a step for adding the first additive, a first dispersing mixing step, a step for adding a second additive, and a second dispersing mixing step are sequentially carried out when the two-step mixing process is carried out by means of the system 400 and the disperser 421 as in FIG. 15, those steps are characterized in that the gap between the rotor and the stator is stepwise broadened in the step for adding the first additive (T32), the gap is stepwise narrowed in the first dispersing mixing step (T33), the gap is stepwise broadened in the step for adding the second additive (T34), and the gap is stepwise narrowed in the second dispersing mixing step (T35). Incidentally, the gap was stepwise broadened and narrowed in the above example. However, the gap can be continuously changed. The control in those steps in which "the gap is gradually broadened during a period for adding powder and the gap is gradually narrowed during the dispersing mixing step after the step for adding powder is completed" is effective also in a one-step mixing process. The control is repeated twice in the above example. Those steps are further characterized in that the gap at the time when the step for adding the second additive (T34) is completed is narrower than that at the time when the step for adding the first additive (T32) is completed. Further, the gap when the step for adding the second additive (T34) is started is set at a smaller value than that when the step for adding the first additive is started (T32). In addition, the gap at the time of the termination (T36) is set at a smaller value than that when the step for adding the second additive (T34) is started. In other words, the dispersion is carried out in a method in which the gap is gradually narrowed to cause the greatest shearing force at the end as a whole, in combination with the method in which "the gap is gradually broadened during a period for adding powder and the gap is gradually narrowed during the dispersing and mixing step after the step for adding powder is completed." The fluctuation of the pressure is suppressed by carrying out the characteristic control of the gap as discussed above and as in FIG. 15. As a result, the two mixing steps are appropriately carried out, and thus an appropriate batch process is achieved.

Namely, the disperser 421 and the system 400 achieve an efficient and appropriate dispersion because of the characteristic buffering space as discussed with reference to FIGS. 1 to 10. In addition, they can prevent a mixture from blocking in the gap D1 between the rotor and the stator, and can prevent a mechanical component or a pipe from being impaired by an increased pressure in the mechanical component or the pipe, because of the configuration that has the mechanism for adjusting the gap (the driving mechanism 420) as discussed with reference to FIG. 11. In addition, the disperser and the system can separate the rotor from the stator because they have the driving mechanism 420, and thereby the system achieves an improved efficiency in the cleaning and the maintenance. Further, the two or more mixing and dispersing steps as discussed above are achieved because of the driving mechanism 420. Thereby the total processing time is shortened. Also, the need for the other separately required device can be eliminated. Further, the entire device can be made smaller.

Also, the circulation-type dispersing method for dispersing a mixture while circulating it, wherein the method is carried out by means of the circulation-type dispersing system 400 comprising the disperser 421, etc., as discussed above; a tank connected to the outlet side of the disperser; a circulating pump for circulating the mixture; and a pipe for serially connecting the disperser, the tank, and the circulating pump, achieves a more efficient and appropriate dispersion.

Further, the method by using the system 400 is characterized in that the disperser 421 has a driving mechanism 420 for driving either the rotor 2 or the opposing member (stator 3) or both, to allow one of them to move toward and away from the other of them, and in that the disperser carries out dispersing while the gap between the rotor and the opposing member is adjusted by controlling the driving mechanism based on either a pressure detected by a pressure sensor 423 for detecting pressure caused by a mixture located between the rotor and the opposing member or a temperature detected by a temperature sensor 424 for measuring a temperature of a mixture discharged from a position between the rotor 2 and the opposing member (stator 3) or both the pressure and the temperature. The method can beforehand detect a state in which a blockage of a mixture can occur. Thus the method can surely prevent a mechanical component or a pipe, etc., from being impaired.

Further, the dispersing method is characterized in that the method comprises the following: a first mixing step for mixing a raw material to be treated with a first additive by dispersing them by means of the disperser while circulating the raw material and adding the first additive into the raw material to obtain a first mixture; and a second mixing step for mixing the first mixture obtained in the first mixing step and a second additive by dispersing them by means of the disperser while circulating the first mixture and adding a second additive into the first mixture to obtain a second mixture. The method enables the system 400 alone to carry out the first and the second mixing steps. Thereby the device can be simplified, and the total processing time can be shortened.

The dispersing method is further characterized in that the gap between the rotor 2 and the opposing member (stator 3) is changed after the first mixing step is completed and before the second mixing step is started. The method can provide an optimal shearing force with each mixture in each step, thereby achieving an appropriate and efficient dispersion. Further, the dispersing method is very effective in adding a thickening material into water and then dispersing any active material therein, as, for example, in obtaining a raw material for electric cells.

The dispersing method, the disperser 421, and the system 400, as discussed above, prevent a mechanical component or a pipe from being impaired by an increased pressure in the pipe because of a blockage of a mixture between a pair of rotors or between a rotor and a stator in the disperser. Thereby they can achieve an appropriate and efficient dispersion. Further, a mixing process consisting of two steps is made possible. Thereby a more appropriate and efficient dispersion can be achieved.

The characteristics of the driving mechanism 420 as discussed with reference to FIG. 11 and the characteristics of the two-step mixing process enabled by the mechanism are to improve the performance of the disperser and the system by exerting the above effects when they work in combination with the characteristics of the buffering space in FIGS. 1 to 10. Those characteristics can also be used in a disperser comprising a rotor and a stator or a pair of rotors that do not have the characteristics of the buffering space as in FIGS. 1 to 10 (for example, a disperser comprising a rotor and a stator which each have a disc-like shape and oppose each other). Such a disperser also exerts the effects caused by the driving mechanism and the effects caused by carrying out the two mixing steps.

The features of the buffering space have been discussed with reference to FIGS. 1 to 10. Also, the features of the driving mechanism for adjusting the gap and the two-step mixing process have been discussed with reference to FIG. 11. Next, below the features of a screw-type powder feeder that can be attached to the tank and can give a better effect are explained with reference to FIGS. 16 to 22

Namely, the above systems 200, 400 can be configured such that a characteristic tank 501 is installed instead of the tanks 201, 401. The screw-type powder feeder 531 is installed in the tank 501 as its characteristic component. The feeder 531 is attached in a state in which the powder-feeding tip 532 is in the mixture in the tank. The tank 501 is installed in the system to prevent a powder material from adhering to an inner surface of the tank and from scattering in the tank and to prevent a powder material from drifting on the surface of the liquid and from condensing, thereby to achieve an appropriate and efficient dispersion. The specific configuration, the mechanism, and the effect of the driving mechanism will be explained with reference to the circulation-type dispersing system 500 in FIG. 16.

Incidentally, the system 500 has the same configuration as that of the system 400 except that the tank 401 and the feeder 406 attached to the tank, etc., are replaced by the tank 501, which has a screw-type powder feeder, etc. So, the same numbers are given to the commonly-used components and the detailed explanations of them will be omitted.

Next, the circulation-type dispersing system 500 of the present invention will be explained with reference to FIGS. 16 and 17. The system 500 in FIG. 16 has the disperser 421, which is a rotor-type continuous-type disperser for splitting a mixture. In the figure, M denotes a motor when it is vertically installed. However, the motor does not have to be so installed, as discussed above. Also, the system 500 has the following: a tank 501 that is connected to an outlet side of the disperser 421, etc.; a circulating pump 402 that is connected to the outlet side of the tank 501 and that circulates the mixture 4; and a pipe 403 for serially connecting the disperser 421, etc., the tank 501, and the circulating pump 402. Incidentally, the disperser in the system 500 is not limited to the disperser 421. The disperser can be any of the above dispersers 1, 31, 71, 81, 91, 131, 191 (a disperser in which a stator is replaced by another rotor is also included) or can be one to which the driving mechanism 420 is added.

Also, for example, as in FIG. 12, the system 500 is installed in the same way that the system 400 is installed. If needed, the system 500 can be connected to the tank 491 for storing powder additives via an additive-supplying pipe 492. Also, an elevating apparatus 495 for raising and lowering a top cover 541*d* of the tank 501 can be installed.

Incidentally, the fluid circulating through the inside of the tank 501, the disperser, or the pipe 403 is initially a raw material (the raw material is a slurry or liquid raw material to be treated). The added raw material (the material is a powder additive in the system 500) is gradually dispersed every time the mixture passes through the disperser. Finally the raw material becomes a dispersed mixture. In the above and the following description, not only a "mixture" while it is being processed but also an initial "raw material" shall be referred to as a "mixture." The term "liquid" in the above and the following description shall include a slurry material, unless otherwise noted.

Also, the system 500 has a driving mechanism 420 installed with the disperser 421, a controlling member 430, a pressure sensor 423, temperature sensors 424, 425, and bulbs 409, 410, 411, etc., as in the system 400.

The system 500 is a system for carrying out a dispersion by means of the shearing disperser, while circulating a raw material to be treated and adding an additive into the raw material. A raw material to be circulated and treated is supplied into the disperser 421 through a feeding passage (a supplying inlet 29*a*) that is provided on the opposing member (stator 3).

The tank 501 has the screw-type powder feeder 531 to supply an additive into a raw material to be treated in the tank 501. The powder-feeding tip 532 of the screw-type powder feeder 531 is inserted into the mixture 4 in the tank 501.

The tank 501 has an agitator 533 for agitating the mixture 4 in the tank 501. The agitating blade 534 of the agitator 533 scrapes out the powder additive that is supplied from the powder-feeding tip 532 into the liquid raw material to be treated in the tank 501 from an area near the outlet of the powder-feeding tip 532. Then the powder additive is dispersed in the liquid raw material in the tank 501.

The screw-type powder feeder 531 has a deaerator for deaerating the powder 535. Incidentally, in the tank 501, the deaerator 535 can be omitted. When the deaerator 535 is installed, air contained in powder can be removed before a liquid is supplied.

Also, a decompressing pump 536 for decompressing the inside of the tank 501 is installed in the tank 501. Incidentally, in the tank 501, the decompressing pump 536 can be omitted. Below the effects caused by installing the decompressing pump 536 are discussed.

Hereafter, the system 500 will be explained more specifically. As in FIGS. 16 and 17, the screw-type powder feeders 531, such as a screw feeder for supplying powder, is installed above the tank 501, in which liquid is stored such that the tip (546*a*) of an introducing pipe 546 of the screw feeder is immersed in the liquid (mixture 4 [incidentally, the liquid is initially a liquid raw material 547]). The agitating blade 534 for agitating the liquid in the tank 501 to be dispersed is operated such that the powder 542 that has been supplied by the screw feeder into the liquid is directly mixed with the liquid.

This tank 501 is an apparatus that supplies powder to a liquid and carries out a dispersion (the apparatus can be referred to also as a disperser due to such a function). The tank 501 comprises a tank body 541 for storing liquid, the screw-type powder feeder 531, and the agitator 533. The screw-type powder feeder 531 has a hopper 543 for storing powder 542, a screw 544 for supplying the powder 542 into the tank body 541 from the hopper 543, a motor unit 545 for driving the screw 544, and an introducing pipe 546 for introducing the screw 544 into the liquid. The agitator 533 has an agitating blade 534 for dispersing a liquid material 547 and a powder material 542 and a motor unit 548 for driving the agitating blade 534. For example, the tank body 541 has a cylindrical barrel 541*c*, a curved lower blocking member 541*a*, and a plate-like top cover 541*d* for blocking the top. An outlet 541*b* is formed around the center of the lower blocking member 541*a* of the tank body 541. The agitator 533 is attached to the center of the tank body 541 in a horizontal plane. Also, the screw-type powder feeder 531 is attached to a position that deviates from the center in a horizontal plane.

The screw 544 and the introducing pipe 546 are installed such that the tips of them are immersed in the liquid material 547 stored in the tank body 541. The agitating blade 534 has a shape that defines a gap D2 (0.5-10 mm) as in FIG. 17 and that scratches away the powder 542 that has been supplied to the liquid by the introducing pipe 546.

Figure 17:
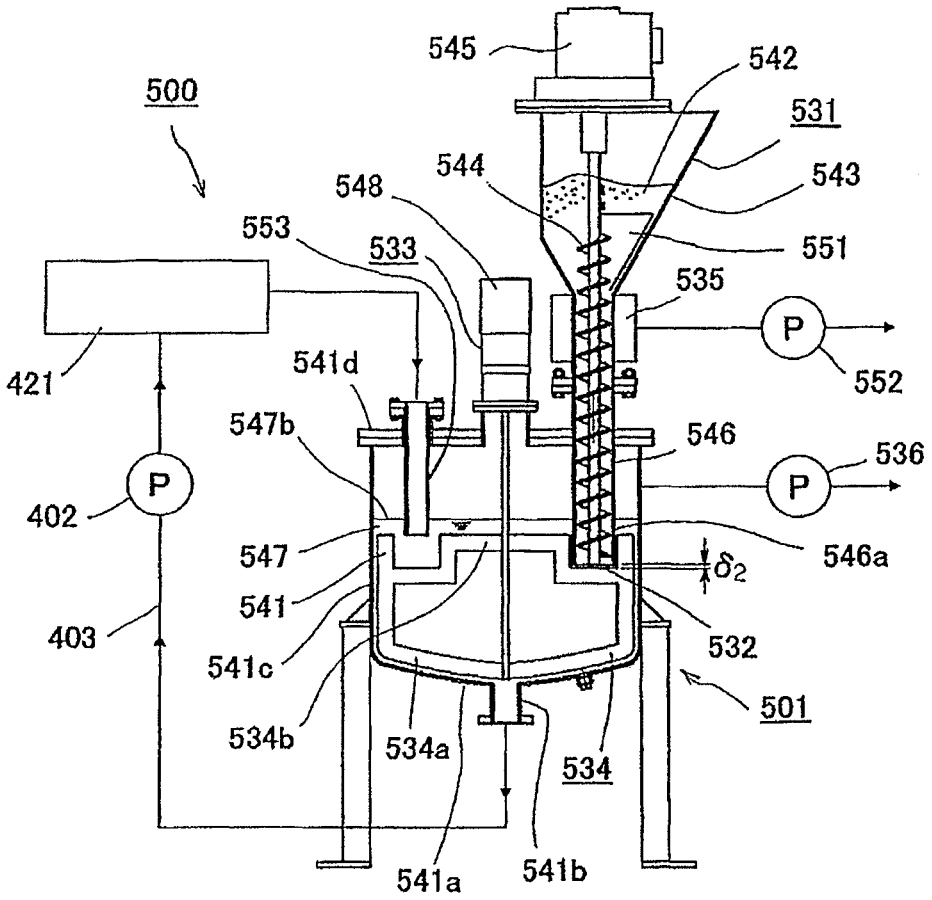
FIG. 17 is a schematic sectional view of the configuration of the tank in the circulation-type dispersing system in FIG. 16.
Figure 18:
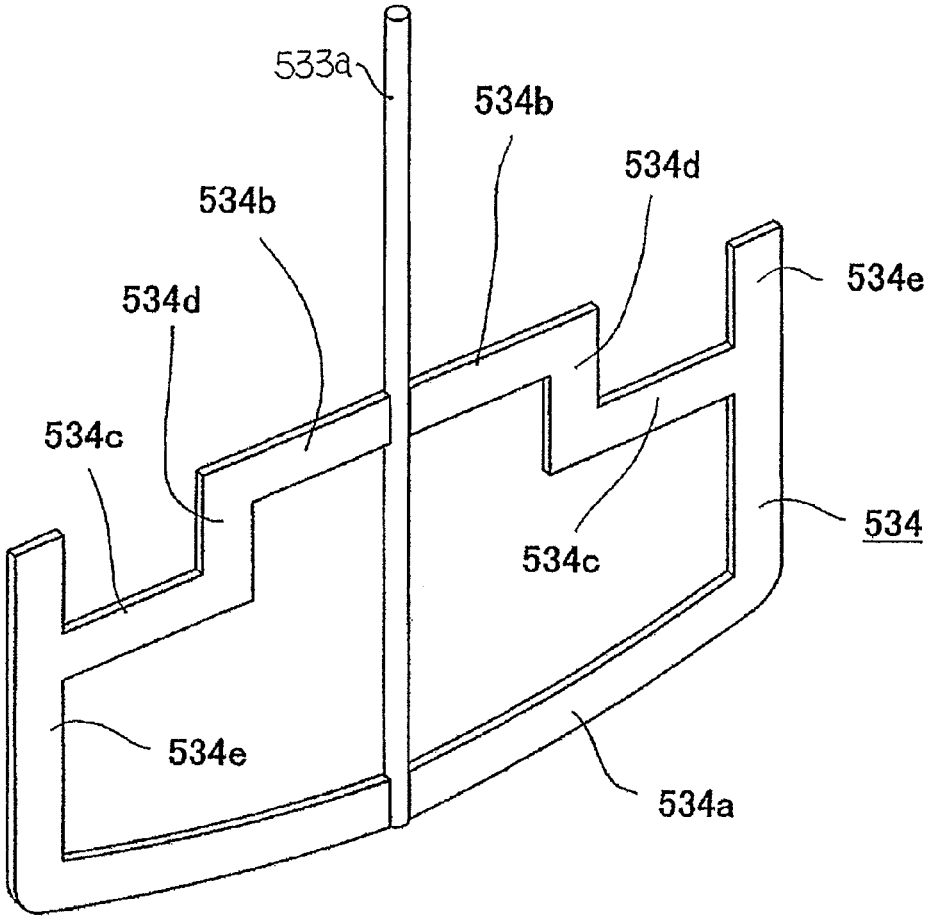
FIG. 18 is a perspective view of the agitating blade of the tank in FIG. 17.

More specifically, as in FIG. 17 and FIG. 18, the agitating blade 534 is disposed to have a predetermined gap (1 to 50 mm) between it and the bottom 541*a* of the tank body 541. The blade has a bottom-agitating member 534*a* for agitating liquid near the bottom 541*a* and a liquid-surface-agitating member 534*b* for agitating the liquid near its surface 547*b*. The member 534*b* is disposed to have a predetermined gap (10 to 200 mm) between it and the surface 547*b* of the liquid in the tank body 541. The member 534*a* and the member 534*b* are rotated by being connected to the rotating shaft 533*a* of the agitator 533.

The agitating blade 534 has a powder-scratching member 534*c*, connecting members 534*d*, and connecting members 534*e*. The powder-scratching members 534*c* are parallel to the liquid-surface-agitating members 534*b* and are disposed below the members 534*b* (at a position nearer the member 534*a* than are the members 534*b*). The members 534*c* are formed to have the above predetermined gap D2 (0.5-10 mm) between them and the tip of the screw-type powder feeder 531 (the powder-feeding tip 532).

The respective connecting members 534*d* are vertically formed to connect the respective liquid-surface-agitating members 534*b* with the respective powder-scratching members 534*c* that are each located at a position outward from the members 534*b*. The respective connecting members 534*e* are formed in parallel with the respective connecting members 534*d*. Also, the respective connecting members 534*e* connect the bottom-agitating members 534*a* to the powder-scratching members 534*c*. Further, the respective connecting members 534*e* extend to the same height as those of the respective liquid-surface-agitating members 534*b*. The respective connecting members 534*d* and the respective connecting members 534*e* are formed to provide the predetermined gap D2 between the agitating blade 534 and the introducing pipe 546 when the agitating blade 534 passes by the introducing pipe 546.

The entire agitating blade 534 is formed to be plate-like. Incidentally, two or more of the plate-like members as above can be installed and combined such that they have regular intervals in the direction of the rotation. Thereby the agitating performance is improved. A scraper 551 that is connected to the screw 544 prevents the powder 542 in the hopper 543 from adhering to the inner wall of the hopper and from bridging (causing a bridge).

If the powder 542 consists of fine particles containing much air, the air can be removed from the powder by means of the deaerator 535, which is installed at a position along the screw 544 in FIG. 17, before the powder is supplied into the liquid. The deaerator 535 is a filter made from a metal or ceramics. It has a function to vacuum the air contained in powder from a position along the introducing pipe by means of a vacuum pump 552. Thereby the air contained in powder can be removed (deaerated). As a result, the deaerator can prevent air from being mixed into liquid. This is particularly effective in shortening the time for degassing after the dispersion when the liquid has a high viscosity. Also, the speed of supplying a mixture can be quickened because the apparent density (the density is also referred to as "bulk density") of the powder increases. The term "bulk density" means a value obtained by measuring the mass of powder packed in a container having a known volume and then dividing the measured mass by the known volume.

Because of the screw-type powder feeder 531 and the agitator 533, which each have the above configurations, the tank 501 can prevent a powder material from adhering to the inner surface of the tank and from scattering in the tank and can prevent a powder material from drifting on the surface of the liquid or condensing. Thereby the tank 501 achieves an appropriate and efficient dispersion.

The tank 501 itself has a dispersing function. However, the dispersing performance of the tank 501 can be remarkably improved by connecting it to the disperser 421, etc., is a shearing disperser having a high dispersing performance, via the pipe 403 as in FIG. 16 or FIG. 17 and circulating the liquid in the tank by means of the pump 402 to repeat the dispersion by means of the disperser 421.

The circulation in the system 500, which has the tank 501, can prevent powder from remaining on the surface of the liquid and from being deposited on the bottom of the tank when the powder has a specific gravity that is greatly different from that of the liquid. Namely, the circulation can prevent a uniform dispersion from being inhibited. The disperser 421, which is installed in this circulation-type dispersing system, is effective especially when the liquid has a high viscosity. The agitating blade of the tank 501 cannot easily cause a convective flow when the liquid has a high viscosity. In that case, the dispersing effect deteriorates. However, the shear-type disperser can exert a dispersing function on a mixture having a high viscosity.

The tank 501 has an introducing pipe 553 for returning the mixture 4, which is sent via the pipe 403 and dispersed by the disperser 421 in the system 500, into the tank (for supplying the circulating mixture into the tank). The tip of the introducing pipe 553 is formed such that it soaks in the liquid in the tank. The introducing pipe 553 prevents the returned mixture 4 from falling on the surface of the liquid in the tank and thereby from forming droplets attached to the inner wall of the tank.

The decompressing pump 536 connected to the tank body 541 serves to defoam the mixture 4.

In the system 500, during the operation the bulb 409 is always open, and the bulbs 410, 411 are always closed. After the dispersion is finished, the bulb 409 is closed, and the bulb 410 is opened. Thereby the processed material can be discharged from the bulb 410 to collect it. Also, the mixture that remains in the disperser 421 or the pipe 403 is discharged and collected by opening the bulb 411. Incidentally, the bulb for discharging and collecting mixtures can be attached to a position in the tank or the pipe.

The system 500 can carry out an efficient and appropriate dispersion because the system has the above disperser 421. Thereby the dispersing function of the entire system is also improved. In addition, the processing time for dispersion is shortened. Further, the system 500 exerts the same effects as those of the above system 400 because it also has the driving mechanism 420. The detailed functions and effects of the system 500 will be omitted, since they are the same as those of the system 400.

Further, the system 500 prevents a powder material from adhering to the inner wall of the tank and from scattering in the tank and prevents the powder material from drifting onto the surface of the liquid and condensing, because the system 500 has the tank 501. Thereby the system 500 achieves an appropriate and efficient dispersion. Also, the system 500 can prevent a powder material from jamming in the hopper or the pipe and can minimize the amount of air mixed in the liquid. Further, the system 500 allows the speed of supplying a mixture to be increased and allows the supply of the mixture to be continuous even when the powder material is fine. In this way, the system 500 achieves an appropriate dispersion.

Specifically, the tank 501 and the system 500, in which the tank is used, can prevent a powder material from scattering within the tank by immersing the tip of the screw feeder into the liquid. Thereby they can solve the problem whereby the scattered powder material can adhere to the inner wall of the tank and the problem wherein droplets spatter and adhere to the inner wall of the tank when the powder material falls on the surface of the liquid.

Further, the tank 501 and the system 500, in which the tank 501 is used, carry out a batch dispersion. They operate the blade for agitating the tank such that a powder material supplied from the screw feeder into liquid is directly mixed with the liquid. Thereby they can mix the powder material with the liquid while they prevent the powder material from drifting near the surface of the liquid and from condensing. Thus the powder material can be dispersed in the liquid.

Further, the tank 501 and the system 500, in which the tank 501 is used, can reduce the amount of the air mixed in the liquid to the minimum because they can carry out deaeration at a position along the screw feeder. In addition, the speed for supplying a powder material can be increased because the apparent density (bulk density) of the powder material is increased. Further, they can suppress the flotation of the powder material in liquid.

Figure 19:
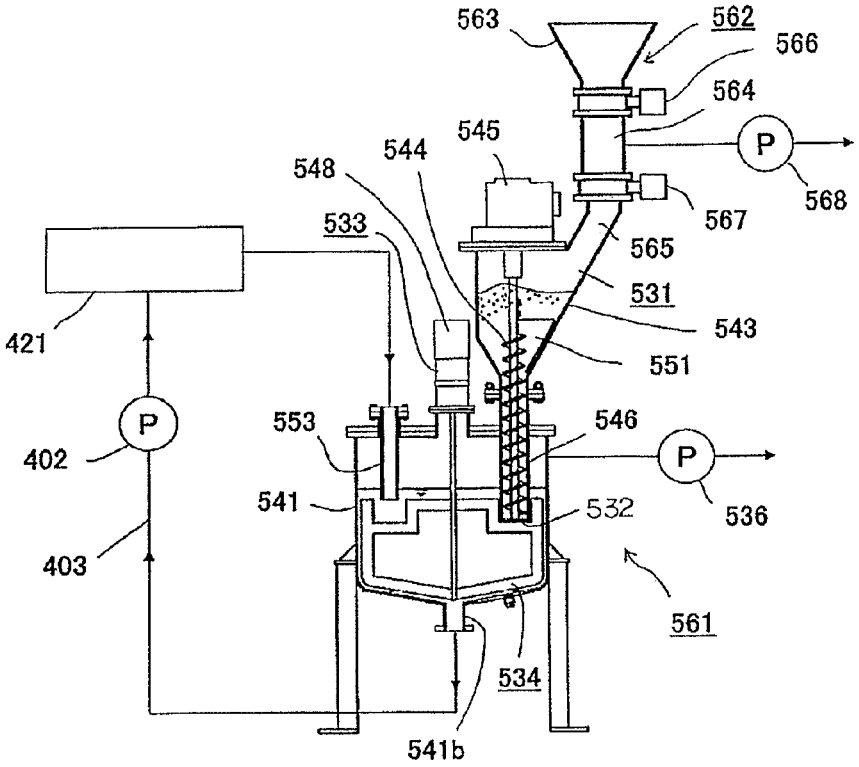
FIG. 19 is a figure of another example of the tank in the circulation-type dispersing system in FIG. 16.

Incidentally, a tank that can be used in the dispersing system 500 is not limited to the tank 501. For example, the tank 561 in FIG. 19 can be used. Namely, the tank 561 in FIG. 19 is a modified example of the tank 501. The tank 561 has substantially the same configuration as that of the tank 501 except that a decompressing mechanism 562 is added to the hopper 543 of the screw-type powder feeder 531. So, the same numbers are given to the commonly-used components and the detailed explanations of them will be omitted.

As in FIG. 19, the tank 561 has a screw-type powder feeder 531, an agitator 533, an agitating blade 534, a decompressing pump 536, a hopper 543, a screw 544, a motor unit 545, an introducing pipe 546, a motor unit 548, a scraper 551, etc. Incidentally, the tank 561 can also have a deaerator 535 as in the tank 501, though the tank 561 was explained in an example in which the deaerator 535 is not installed. In that case, a more appropriate dispersion is achieved because the effects caused by a deaerator are obtained.

Further, the tank 561 has the decompressing mechanism 562. The decompressing mechanism 562 has the following: a supply-receiving member 563 that is installed above the hopper 543; a decompressing pipe 564 and a connecting pipe 565 that connect the supply-receiving member 563 to the hopper 543; bulbs 566, 567; and a decompression pump 568. The bulbs 566, 567 are normally closed.

To supply a powder material into the screw-type powder feeder 531, a powder material is supplied from the supply-receiving member 563 into the decompressing pipe 564 while the bulb 566 is opened. Next, the bulb 566 is closed, and then the inside of the decompressing pipe 564 is decompressed by means of the decompressing pump 568. After decompressing the pipe 564 and while still decompressing it by means of the decompressing pump 568, the bulb 567 is opened to lead a powder material that has been deaerated in the decompressing pipe 564 into the hopper 543 through the connecting piping 565. After completing it, the bulb 567 is closed. Then the decompressing pump 568 is stopped. Incidentally, the decompressing pump 568 can be stopped before the bulb 567 is opened.

The above decompressing mechanism 562 can always keep the inside of the feeder 531 decompressed and can remove the air in the powder. Thereby the defoaming process can be completed quickly. So, the function of the decompressing pump 536 can be fully exerted.

Figure 20:
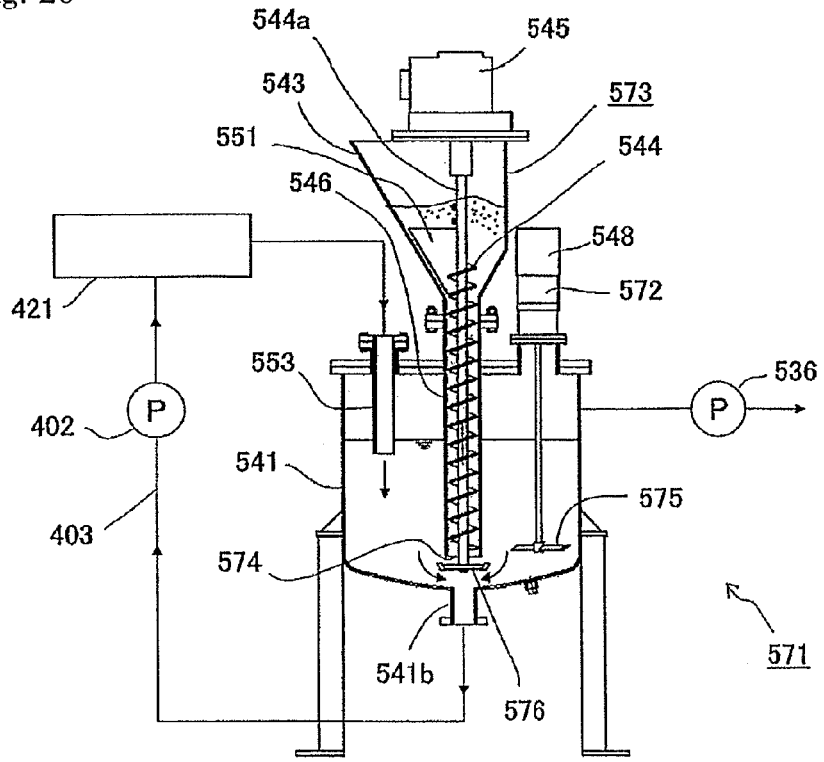
FIG. 20 illustrates yet another example of the tank in the circulation-type dispersing system in FIG. 16.

Incidentally, a tank that can be used in the system 500 is not limited to one of the tanks 501, 561. For example, the tank can be the tank 571 in FIG. 20. Namely, the tank 571 in FIG. 20 is a modified example of the tank 501. The tank 571 has substantially the same configuration as that of the tank 501 except that the position to which the screw-type powder feeder is fixed differs, and that the position to which the agitator is fixed and the structure of the agitator differ, and that a structure for reinforcing the agitation is added. So, the same numbers are given to the commonly-used components. Thus the detailed explanation of the tank 571 will be omitted.

As in FIG. 20, the tank 571 has a screw-type powder feeder 573 that has the same configuration as that of the screw-type powder feeder 531, a hopper 543, a screw 544, a motor unit 545, an introducing pipe 546, a motor unit 548, a scraper 551, etc. The powder-feeding tip 574 of the screw-type powder feeder 573 is inserted in the mixture 4 in the tank 571. Incidentally, the tank 571 can have a deaerator like the deaerator 535 in the tank 501, though the tank 571 is explained in an example in which no deaerator is installed. In that case, both effects are obtained and a more appropriate dispersion is achieved. Also, the decompressing mechanism 562, which was explained with reference to FIG. 19, can be added to the tank 571. In that case, the effect of the decompressing mechanism 562 is obtained and thus a more appropriate dispersion is achieved.

The tank 571 has an agitator 572 for agitating the mixture 4 in the tank 501. In the horizontal plane, the screw-type powder feeder 573 is attached near the center of the tank body 541, and the agitator 572 is attached to a position outward from the center. The powder-feeding tip 574 is disposed in a position nearer the outlet 541*b* of the tank body 541 than is an agitating member (agitating blade 575) of the agitator 572.

A circulating flow causes a powder material to be mixed with the liquid in the tank 571, because the tips of the feeder and its introducing pipe are disposed near the outlet of the tank when they are immersed in the liquid. Thereby the tank 571 can prevent the powder material from drifting near the surface of a liquid and from condensing and thus can disperse the powder material in the liquid even when the liquid has a high viscosity.

Also, the tip 576 of the blade of the screw is installed at the powder-feeding tip 574. The tip 576 of the blade is rotated integrally with the axis 544*a* of the screw 544 of the feeder 573.

In the tank 571, the screw 544, the motor unit 545, etc., are installed at the center of the tank. Also, the tips of the screw 544 and the introducing pipe 546 (the powder-feeding tip 574) are disposed near the outlet 541*b* of the tank. The powder material supplied by the screw 544 into the liquid is caught in a flow of the liquid, because the liquid in the tank is made to flow out of the outlet 541*b*. Thereby the powder material is transported together with the liquid through the pipe 403 into the disperser 421. The problem whereby a powder material can rise in a liquid by its own buoyancy and be exposed to the surface of a liquid without being dispersed in the liquid, and then can scatter in the space of the tank can easily occur, especially when the specific gravity of the powder material is less than that of the liquid. However, the tank 571 has an effect to prevent this problem. A propeller-shaped blade or turbine-shaped blade is used as the agitating blade 575. The blade 575 is disposed and driven at a position displaced from the center of the tank. Thereby the blade 575 can prevent segregation, etc., of the powder material by causing the liquid to circulate because of its agitation.

Figure 21:
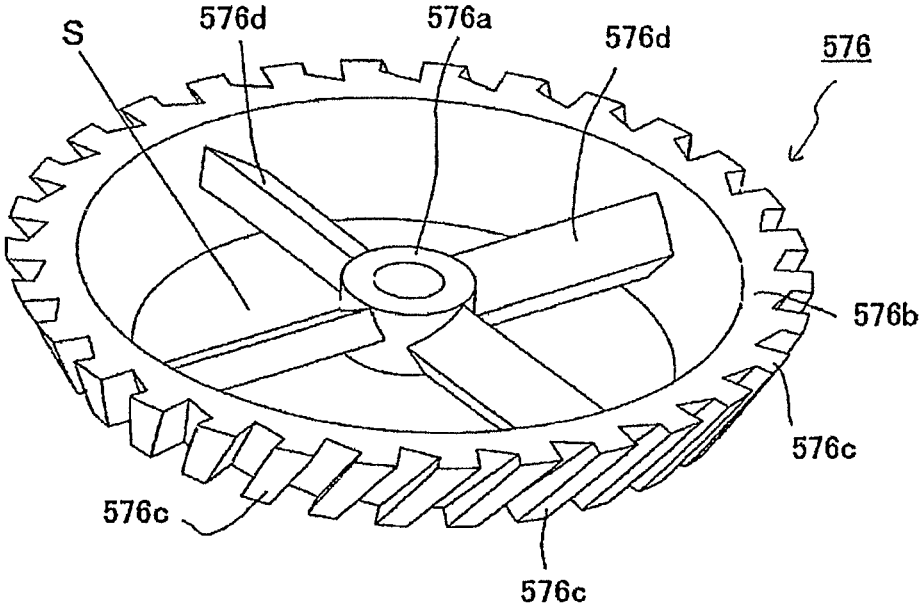
FIG. 21 is a perspective view of a top blade of a screw of the tank in FIG. 20.

As in FIG. 21, the tip 576 of the blade has a shaft-attaching member 576*a* for attaching the blade to the axis 544*a* of the screw 544, a blade-attaching member 576*b* disposed at a position outward from the shaft-attaching member 576*a*, a plurality of blade members 576*c* provided throughout the outer circumference of the blade-attaching member 576*b*, and connecting members 576*d* for connecting the blade-attaching member 576*b* to the shaft-attaching member 576*a*. Incidentally, the connecting members 576*d* are not parallel to the horizontal direction.

The blade-attaching member 576*b* and the shaft-attaching member 576*a* are connected by the connecting members 576*d* such that a large space S is left inside the blade. So, the tip 576 of the blade, which is formed as discussed above, does not block a flow of a powder material, and achieves the following effect. Namely, the tip 576 of the blade has a function to cause a flow toward the outlet 541*b* in addition to having the agitating function by means of its rotation, because the connecting members 576*d*, each of which is an internal component of the blade, are formed to incline.

The blade-attaching member 576*b* and the blade members 576*c*, each of which members is an outward component, have a function to generate a flow toward the outlet 541*b* by their rotation, because many inclined grooves are formed by them. So, the tip 576 of the blade can prevent a powder material from rising by its own buoyancy, because the tip of the blade not only disperses a powder material in a liquid, but also generates a flow toward the outlet.

The tank 571, which has the tip 576 of the blade, can prevent a powder material supplied by the screw into a liquid from condensing and jamming at a position in the pipe after it is discharged from the tank. Also, the tank can prevent a pump and a disperser from being overloaded.

Also, the system 500 can be a circulation-type dispersing system that repeats a process in which liquid processed in a tank is returned to the tank after it is discharged, when the tank 571 is used in the system 500. A powder material is processed while it is being mixed with a flow of a liquid that is being discharged, when the screw 544 and the introducing pipe 546 are installed near the outlet 541*b*. Thereby an efficient dispersion is achieved.

As discussed above, the tanks 561, 571 in FIGS. 19 and 20 not only exert the characteristic effects caused by the above characteristic configuration, but also prevent a powder material from adhering to an inner surface of the tank and from scattering in the tank and prevent a powder material from drifting on the surface of a liquid and from condensing, because they have the screw-type powder feeder 531, 571 and the agitator 533, 572, respectively, as in the tank 501. Thereby an appropriate and efficient dispersion is achieved. Further, when the tanks 561, 571 each have a configuration similar to the configuration of the above tank 501, the tanks can exert similar effects caused by the configuration.

Further, in addition to the effects caused by the tank 561, 571 itself, the system 500, in which the tank 561, 571 is installed, can minimize the amount of air mixed into a liquid and can allow a powder material to be supplied continuously at a higher speed even when the powder material is fine. Thereby an appropriate dispersion is achieved.

As discussed above, the tanks 501, 561, 571, which can be used in the system 500, have been explained with reference to FIGS. 16 to 21. The tanks best perform when they are used in the system 500. However, each of them alone can also cause a dispersion.

Figure 22:
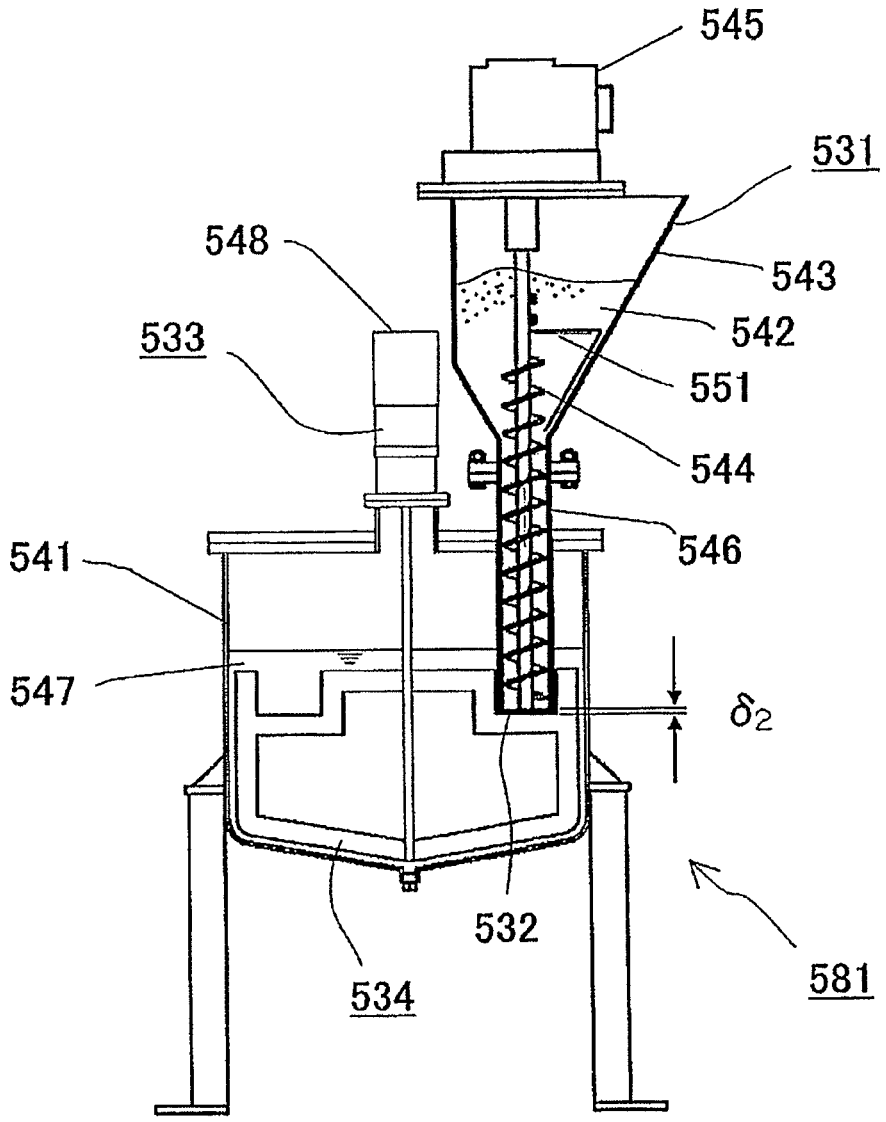
FIG. 22 is a modified example of the tank in FIG. 16.

Namely, the system can consist of a tank 581 as in FIG. 22. Incidentally, the same numbers are given to the commonly-used components. The detailed explanation of the tank 581 will be omitted, because it is the same as the tank 501 in FIG. 17, except that the tank 581 does not have a configuration for circulation (the introducing pipe 553 and the outlet 541*b*).

As in FIG. 22, the tank 581 has the screw-type powder feeder 531, the agitator 533, the agitating blade 534, the hopper 543, the screw 544, the motor unit 545, the introducing pipe 546, the motor unit 548, the scraper 551, etc. Incidentally, the tank 581 can have the deaerator 535 and the decompressing pump 536 as in the tank 501, though the tank 581 was explained in an example in which the deaerator 535 and the decompressing pump 536 were not installed. In the former case, the effects caused by them are also obtained and thereby a more appropriate dispersion is achieved.

The tank 581 prevents a powder material from adhering to an inner surface of the tank and from scattering in the tank and prevents a powder material from drifting on the surface of a liquid and from condensing, because the tank 581 has the screw-type powder feeder 531 and the agitator 533. Thereby an appropriate and efficient dispersion is achieved. Incidentally, as discussed above, the tank 581 is a modified example in which the tank 501 is used alone. Also, each tank 561, 571 alone gives the same effects.

Next, the dispersing method by means of the tank 501, 561, 571, 581 is explained. In the dispersing method, a slurry or liquid raw material to be processed is stored in the tank body 541 of the tank 501, 561, 571, 581 (hereafter, the tank will be referred to as the "tank 501, etc."). Then a powder additive to be mixed with the raw material is supplied and dispersed in the tank. The dispersing method is characterized in that an additive is supplied and dispersed in a raw material that is in the tank body and that is to be processed, in a state in which the powder-feeding tip 532, 574 of the screw-type powder feeder 531, 573 is in the mixture in the tank body, which is installed integrally with the tank body 541.

The dispersing method using the system 500, which uses the tank 501, 561, 571, is characterized in that a mixture is dispersed while it is being circulated through the tank 501, 561, 571, disperser 421, etc., and the pipe 403, by means of the circulating pump 402, and in that an additive is added to a raw material that is in the tank body and will be processed, to disperse the mixture of them in a state in which the powder-feeding tip 532, 574 of the screw-type powder feeder 531, 573, which is installed to be integrated with the tank body 541, is in the mixture in the tank body.

The above dispersing method is further characterized in that a mixture consisting of a raw material to be processed and an additive in the tank body is agitated by means of the agitator 533 installed in the tank 501, etc., and in that the mixture is dispersed while the agitating blade 534 of the agitator scrapes out a powder additive that is supplied by the powder-feeding tip into a raw liquid material in the tank to be processed, at the time an additive is supplied and dispersed.

Further, the dispersing method is further characterized in that a powder additive is deaerated by the deaerator 535 that is installed in the tank at the time the additive is supplied.

The dispersing method is further characterized in that a mixture in the tank body consisting of a raw material to be treated and an additive is agitated by means of the agitator 572 that is installed in the tank when an additive is added and dispersed, and in that the powder-feeding tip 574 is disposed in a position nearer the outlet of the tank body than is the agitator 572.

The dispersing method is further characterized in that a mixture is dispersed while it is agitated by means of the tip of the blade 574 that is installed on the powder-feeding tip 574 and that rotates integrally with the axis 544*a* of the screw of the screw-type powder feeder 573, at the time an additive is supplied and dispersed.

The dispersing method is further characterized in that an additive is dispersed by means of the decompressing pump 536 installed in the tank while decompressing the inside of the tank body at the time an additive is supplied and dispersed.

The above dispersing method, the tank 501, 561, 571, 581, and the system 500, can prevent a powder material from adhering to an inner surface of the tank and from scattering in the tank and can prevent a powder material from drifting on the surface of a liquid and from condensing. Thereby an appropriate and efficient dispersion is achieved.

DENOTATION OF THE REFERENCE NUMBERS 1 disperser
2 rotor
3 stator
4 mixture
5 first gap
6 second gap
7 buffering space
8 wall
420 driving mechanism
531 screw-type powder feeder

What we claim is:

1. A shearing disperser comprising:

a rotor; and an opposing member that is opposite the rotor, the opposing member being spaced apart from the rotor, each of a plurality of gap-defining surfaces of the rotor and each of a plurality of gap-defining surfaces of the opposing member facing each other being formed such that they define a plurality of gaps, wherein the disperser disperses a slurry or liquid mixture by allowing the mixture to pass through the disperser and outwardly between the rotor and the opposing member by centrifugal force, and wherein the plurality of gaps are provided between the gap-defining surfaces of the rotor and the gap-defining surfaces of the opposing member, the plurality of gaps leading the mixture outwardly, the plurality of gaps including an outermost gap and a gap that is located in a position inward from the outermost gap; and wherein the rotor and the opposing member respectively have a buffering-space-defining surface of the rotor and a buffering-space defining surface of the opposing member, the buffering-space-defining surfaces defining a buffering space, the buffering space being provided to connect the outermost gap to the gap that is located in a position inward from the outermost gap and retaining the mixture, and wherein the opposing member is located below the rotor and formed such that the gap-defining surfaces of the opposing member slope downward from an inner position to outer position.

2. The shearing disperser of claim 1, wherein the plurality of gaps have a configuration in which one of the plurality of gaps is narrower than the other gap that is located in a position inward from the one of the plurality of gaps.

3. The shearing disperser of claim 2, wherein the rotor and the opposing member are disposed such that a rotating shaft of the rotor is parallel to a vertical direction.

4. The shearing disperser of claim 3, wherein the rotor or the opposing member or both are provided with a supplying opening for supplying the mixture from a center of a rotation of the rotor.

5. The shearing disperser of claim 4, wherein an inside wall of the rotor or the opposing member or both defining a coolant-circulating-space in which a coolant for cooling the mixture between the rotor and the opposing member circulates are provided within the rotor or the opposing member of both.

6. The shearing disperser of claim 5, wherein the plurality of gaps between the rotor and the opposing member are each 2 mm or less.

7. The shearing disperser of claim 1, wherein the rotor and the opposing member have further respectively a buffer-space-defining surface of the rotor and a buffering-space-defining surface of the opposing member, the buffering-space-defining surfaces defining a second buffering space, the second buffering space being provided to connect the gap that is located in a position inward from the outermost gap to a gap that is located in a more inward position such that the mixture is retained in the second buffering space.

8. The shearing disperser of claim 2, wherein the rotor and the opposing member are disposed such that a rotating shaft of the rotor is horizontal.

9. The shearing disperser of claim 1, wherein the disperser further comprises a driving mechanism for driving either the rotor or the opposing member or both to allow one of them to move toward and away from the other of them.

10. The shearing disperser of claim 9, wherein the disperser further comprises a controller, and wherein the controller adjusts the gaps between the rotor and the opposing member by controlling the driving mechanism based on either a pressure detected by a pressure sensor for detecting pressure caused by a mixture between the rotor and the opposing member or a temperature detected by a temperature sensor for measuring a temperature of a mixture discharged from a position between the rotor and the opposing member or both the pressure and the temperature.

11. The shearing disperser of claim 10, wherein the driving mechanism is a servocylinder.

12. The shearing disperser of claim 9, wherein the disperser is used in a circulation-type dispersing system for dispersing a mixture while circulating it, wherein the disperser is an apparatus that carries out a first mixing step for mixing a raw material to be treated and a first additive by dispersing them and carries out a second mixing step for mixing a first mixture obtained by completing the first mixing step and a second additive by dispersing them, and wherein the driving mechanism changes the gaps between the rotor and the opposing member after the first mixing is completed and before the second mixing is started.

13. The shearing disperser of claim 12, wherein the raw material to be treated is water, the first additive is a thickening material, and the second additive is an active material.

14. The shearing disperser of claim 13, wherein the driving mechanism sets the gaps at a broader value when the first mixing step is started, and then it gradually narrows the gaps while the mixture is being dispersed, and wherein the driving mechanism further narrows the gaps after the first mixing step is completed and before the second mixing step is started.

15. The shearing disperser of claim 1, wherein the opposing member has a rotating shaft parallel to a rotating shaft of the rotor, and wherein the opposing member is a second rotor that rotates in a direction opposite a direction of rotation of the rotor.

16. A circulation-type dispersing system for dispersing the mixture while circulating it, wherein the system comprises the following: the shearing disperser of claim 15; a tank that is connected to an outlet side of the shearing disperser; a circulating pump for circulating the mixture; and a pipe for serially connecting the shearing disperser, the tank, and the circulating pump.

17. A circulation-type dispersing system for dispersing a mixture while circulating it, wherein the system comprises: the shearing disperser of claim 1; a tank that is connected to an outlet side of the shearing disperser; a circulating pump for circulating the mixture; and a pipe for serially connecting the shearing disperser, the tank, and the circulating pump.

18. The circulation-type dispersing system of claim 17, wherein the system carries out a first mixing step for mixing a raw material to be treated with a first additive, and then carries out a second mixing step for mixing a first mixture, obtained by completing the first mixing step, with a second additive.

19. The circulation-type dispersing system of claim 18, wherein the raw material to be treated is water, the first additive is a thickening material, and the second additive is an active material.

20. The circulation-type dispersing system of claim 17, wherein the mixture is obtained by mixing a Murry or liquid raw material to be treated with a powder additive, wherein the system disperses the mixture with the shearing disperser while circulating the raw material and adding the additive to the raw material, wherein the raw material is fed into the shearing disperser through a feeding passage provided in the opposing member, wherein the tank is provided with a screw-type powder feeder for feeding the additive into the raw material in the tank, and wherein a tip of a powder-feeding part of the screw-type powder feeder is in the mixture in the tank.

21. The circulation-type dispersing system of claim 20, wherein the tank has an agitator for agitating the mixture in the tank, and wherein an agitating blade of the agitator scrapes out the powder additive fed from the tip of the powder-feeding part into the raw material in the tank.

22. The circulation-type dispersing system of claim 20, wherein the screw-type powder feeder has a deaerator for deaerating the powder.

23. The circulation-type dispersing system of claim 20, wherein the tank has an agitator for agitating the mixture in the tank, and wherein the tip of the powder-feeding part is disposed in a position closer to an outlet of the tank than is the tip is closer to the agitator.

24. The circulation-type dispersing system of claim 23, wherein the system is provided with an apical screw blade that is connected to a head of the screw at a tip of the powder-feeding part, and wherein the blade rotates in conjunction with an axis of the screw of the screw-type powder feeder.

25. The circulation-type dispersing system of claim 20, wherein the tank is provided with a decompression pump for decompressing an inner part of the tank.

26. A circulation-type dispersing method for dispersing a mixture while circulating it by means of a circulation-type dispersing system, wherein the system comprises: the shearing disperser of claim 1; a tank connected to an outlet side of the shearing disperser; a circulating pump for circulating the mixture; and a pipe for serially connecting the shearing disperser, the tank, and the circulating pump, wherein the disperser comprises a rotor and an opposing member that is opposite the rotor, wherein the disperser disperses the mixture in a slurry or liquid form by allowing the mixture to pass through the disperser and outwardly between the rotor and the opposing member by centrifugal force, wherein the disperser further comprises the following: a plurality of gaps that are provided between the rotor and the opposing member and lead the mixture outwardly; and a buffering space that is provided to connect an outermost gap to a gap located in a position inward from the outermost gap and that retains the mixture, wherein the buffering space is configured such that an outer wall that defines the buffering space is provided on the rotor.

* * * * *